US010179716B2

(12) United States Patent
Moriwaki et al.

(10) Patent No.: US 10,179,716 B2
(45) **Date of Patent: *Jan. 15, 2019**

(54) PAPER SHEET STACKING AND FEEDING APPARATUS AND PAPER SHEET HANDLING DEVICE

(71) Applicant: GLORY LTD., Himeji-shi, Hyogo (JP)

(72) Inventors: Sotaro Moriwaki, Hyogo (JP); Tsuguo Mizoro, Hyogo (JP); Michio Yamamoto, Hyogo (JP); Yoichi Takemura, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/485,314

(22) Filed: Apr. 12, 2017

(65) Prior Publication Data

US 2017/0283211 A1 Oct. 5, 2017

Related U.S. Application Data

(63) Continuation of application No. 14/915,655, filed as application No. PCT/JP2014/071217 on Aug. 11, 2014, now Pat. No. 9,656,834.

(30) Foreign Application Priority Data

Sep. 13, 2013 (JP) ..... 2013-190064

(51) Int. Cl.
*B65H 83/02* (2006.01)
*B65H 29/22* (2006.01)
(Continued)

(52) U.S. Cl.
CPC ..... *B65H 83/02* (2013.01); *B65H 3/06* (2013.01); *B65H 29/125* (2013.01); *B65H 29/14* (2013.01);
(Continued)

(58) Field of Classification Search
CPC ..... B65H 29/20; B65H 29/22; B65H 29/38; B65H 29/40; B65H 83/02;
(Continued)

(56) References Cited

U.S. PATENT DOCUMENTS 7,243,914 B2 * 7/2007 Tokunaga ..... B65H 3/06 271/3.01
7,380,784 B2 * 6/2008 Mizuno ..... B65H 3/06 271/207
(Continued)

FOREIGN PATENT DOCUMENTS

CN 101327879 A 12/2008
CN 101786564 A 7/2010
(Continued)

OTHER PUBLICATIONS

Japanese Office Action with English Translation (Application No. 2013-190064) (8 pages—dated Aug. 2, 2017).
(Continued)

*Primary Examiner* — Ernesto A Suarez
(74) *Attorney, Agent, or Firm* — Renner, Kenner, Greive, Bobak, Taylor & Weber

(57) ABSTRACT

A stacking wheel mechanism (30) includes a stacking wheel (32) that is arranged near a stacking unit (26) and having a plurality of elastic blades (32*a*) on an outer circumferential surface thereof, and a blade guiding member (38) that is arranged near the stacking wheel (32) to guide the blades (32*a*) of the stacking wheel (32). The blade guiding member (38) guides the blades (32*a*) of the stacking wheel (32) such that the blades (32*a*) of the stacking wheel (32) enter into a transport path (for example, an internal transport path (36)) when the stacking wheel (32) rotates in a feeding-in direction of a paper sheet toward the stacking unit (26) and the blades (32*a*) of the stacking wheel (32) retreat from the transport path when the stacking wheel (32) rotates in a
(Continued)

feeding-out direction of the paper sheet from the stacking unit (26).

20 Claims, 14 Drawing Sheets

(51) Int. Cl.

| | |
|---|---|
| ***B65H 29/12*** | (2006.01) |
| ***B65H 29/14*** | (2006.01) |
| ***B65H 31/06*** | (2006.01) |
| ***B65H 31/10*** | (2006.01) |
| ***G07D 11/00*** | (2006.01) |
| ***B65H 3/06*** | (2006.01) |

(52) U.S. Cl.
CPC ..... *B65H 29/22* (2013.01); *B65H 31/06* (2013.01); *B65H 31/10* (2013.01); *B65H 83/025* (2013.01); *G07D 11/0081* (2013.01); *B65H 2403/942* (2013.01); *B65H 2404/1114* (2013.01); *B65H 2404/661* (2013.01); *B65H 2404/693* (2013.01); *B65H 2404/7412* (2013.01); *B65H 2701/1912* (2013.01)

(58) Field of Classification Search
CPC ..... B65H 2404/1114; B65H 2404/114; B65H 2404/1151; B65H 2404/561; B65H 2404/661; B65H 2404/693
See application file for complete search history.

(56) References Cited

U.S. PATENT DOCUMENTS

| | | | | |
|---|---|---|---|---|
| 7,722,024 | B2 * | 5/2010 | Jeong | B65H 3/06 271/3.01 |
| 7,942,401 | B2 * | 5/2011 | Jeong | B65H 3/06 271/3.08 |
| 8,276,902 | B2 * | 10/2012 | Holland-Letz | B65H 29/40 271/3.14 |
| 8,459,633 | B2 * | 6/2013 | Lee | B65H 3/0653 271/10.04 |
| 9,514,617 | B2 * | 12/2016 | Moon | B65H 83/025 |
| 2003/0047601 | A1 | 3/2003 | Nomiyama et al. | |
| 2015/0371507 | A1 | 12/2015 | Moon | |

FOREIGN PATENT DOCUMENTS

| | | | |
|---|---|---|---|
| CN | 102249113 | A | 11/2011 |
| EP | 1 411 012 | A2 | 4/2004 |
| JP | 6-109490 | A | 4/1994 |
| JP | 3099097 | B2 | 10/2000 |
| JP | 2005-247497 | A | 9/2005 |
| JP | 2007-112602 | A | 5/2007 |
| JP | 2008-308324 | A | 12/2008 |
| JP | 4718297 | B2 | 7/2011 |
| JP | 2011-241068 | A | 12/2011 |
| WO | WO 2008/111155 | A1 | 9/2008 |
| WO | WO 2012/029399 | A1 | 3/2012 |

OTHER PUBLICATIONS

Extended European Search Report (Application No. 14843751.0 / PCT/JP2014/071217) (9 pages—dated Nov. 16, 2017).
Written Opinion of the International Searching Authority (English Translation) (International Application No. PCT/JP2014/071217) (5 pages—dated Oct. 28, 2014)
United States Office Action (U.S. Appl. No. 14/915,655) (17 pages—dated Oct. 10, 2016).
Chinese Office Action with English Translation (Application No. 201480050125.3) (15 pages—dated Oct. 10, 2016).
Chinese Office Action (Application No. 201710568165.2), (9 pages—dated Jul. 4, 2018).
English Translation of Chinese Office Action (Application No. 201710568165.2), (9 pages—dated Jul. 4, 2018).
Indonesian Office Action with English Translation (Application No. P00201601471), (4 pages—dated Sep. 20, 2018).

* cited by examiner

PAPER SHEET STACKING AND FEEDING APPARATUS AND PAPER SHEET HANDLING DEVICE

CROSS-REFERENCE TO RELATED APPLICATION

This is a Continuation of application Ser. No. 14/915,655 filed on Mar. 1, 2016, which was the National Stage of International Application No. PCT/JP2014/071217 filed on Aug. 11, 2014.

TECHNICAL FIELD

The present invention relates to a paper sheet stacking and feeding apparatus for stacking a paper sheet in a stacking unit and feeding out the paper sheet from the stacking unit. The present invention also relates to a paper sheet handling device.

BACKGROUND ART

Paper sheet stacking and feeding apparatuses capable of stacking paper sheets, such as banknotes, checks, valuable securities, in a stacking unit, and feeding out the paper sheets from the stacking unit are known in the art (see, for example, Japanese Patent Application Laid-open No. H06-109490 (JP06-109490A) and the like). In such a paper sheet stacking and feeding apparatus, a stacking wheel, on an outer circumferential surface of which a plurality of elastic blades made of rubber and the like are provided, is arranged near the stacking unit. When the stacking wheel is rotated when stacking a paper sheet in the stacking unit, tip end portions of the blades of the stacking wheel contact the surface of the paper sheet that is transported along a transport path and the paper sheet is surely transported into the stacking unit by the blades of the stacking wheel.

SUMMARY OF INVENTION

When a paper sheet is to be stacked in the stacking unit of the conventional paper sheet stacking and feeding apparatus disclosed in Japanese Patent Application Laid-open No. H06-109490 and the like, the stacking wheel is moved to an entering position (for example, see FIG. 9(*b*) of Japanese Patent Application Laid-open No. H06-10940) at which the blades of the stacking wheel enter into the transport path of the paper sheet. By employing such a configuration, when the stacking wheel is rotated in a feeding-in direction of the paper sheet toward the stacking unit, the blades of the stacking wheel contact a surface of the paper sheet that is transported along the transport path. However, when feeding out the paper sheet from the stacking unit, if the blades of the stacking wheel are present in the transport path, they may disadvantageously contact the paper sheet and become obstacle when feeding out the paper sheet from the stacking unit. Therefore, when the paper sheet is to be fed out from the stacking unit, the stacking wheel is moved to a retreating position (for example, see FIG. 9(*a*) of Japanese Patent Application Laid-open No. H06-109490) at which the blades of the stacking wheel are retreated from the transport path of the paper sheet.

However if the stacking wheel is to be moved between the entering position and the retreating position as disclosed in the above conventional paper sheet stacking and feeding apparatus, because a mechanism to move the stacking wheel becomes necessary, the cost of the paper sheet stacking and feeding apparatus increases. Moreover, to move the stacking wheel between the entering position and the retreating position, because a retreating space in which the stacking wheel can be retreated needs to be secured, the downsizing of the device cannot be realized.

The present invention has been made in view of the above discussion. It is an object of the present invention to provide a paper sheet stacking and feeding apparatus and a paper sheet handling device that allow, when feeding out paper sheets from a stacking unit, to retreat the blades of the stacking wheel from the transport path without moving the stacking wheel, thereby making it possible to suppress the costs since it is not necessary to provide the mechanism to move the stacking wheel, and making it possible to downsize the device since it is not necessary to secure the retreating space for the stacking wheel.

A paper sheet stacking and feeding apparatus of the present invention is a paper sheet stacking and feeding apparatus for stacking a paper sheet in a stacking unit and feeding out the paper sheet from the stacking unit, including: a transport path along which the paper sheet passes during both of stacking the paper sheet in the stacking unit and feeding out the paper sheet from the stacking unit; a stacking wheel that is rotatable in both of a feeding-in direction of the paper sheet toward the stacking unit and a feeding-out direction of the paper sheet from the stacking unit, the stacking wheel having a plurality of elastic blades on an outer circumferential surface thereof; and a blade guiding member that guides the blades of the stacking wheel such that the blades enter into the transport path when the stacking wheel rotates in the feeding-in direction of the paper sheet toward the stacking unit and the blades do not enter into the transport path when the stacking wheel rotates in the feeding-out direction of the paper sheet from the stacking unit, and the blade guiding member is fixedly provided so that the blade guiding member does not move.

The paper sheet stacking and feeding apparatus of the present invention may further include: a paper-sheet guiding member that guides the paper sheet so that the paper sheet is transported along the transport path; and an opening arranged to the paper-sheet guiding member so that the blades of the stacking wheel pass through the opening; and the blade guiding member guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

A paper sheet stacking and feeding apparatus of the present invention is a paper sheet stacking and feeding apparatus for stacking a paper sheet in a stacking unit and feeding out the paper sheet from the stacking unit, including: a transport path along which the paper sheet passes during both of stacking the paper sheet in the stacking unit and feeding out the paper sheet from the stacking unit; a paper-sheet guiding member that guides the paper sheet so that the paper sheet is transported along the transport path; a stacking wheel that is rotatable in both of a feeding-in direction of the paper sheet toward the stacking unit and a feeding-out direction of the paper sheet from the stacking unit, the stacking wheel having a plurality of elastic blades on an outer circumferential surface thereof; an opening arranged to the paper-sheet guiding member so that the blades of the stacking wheel pass through the opening; a blade guiding member that guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

In the paper sheet stacking and feeding apparatus of the present invention, the opening may be arranged so that the blades do not pass through the opening when the stacking wheel rotates in the feeding-out direction of the paper sheet from the stacking unit.

In the paper sheet stacking and feeding apparatus of the present invention, the blade guiding member may include a tip end portion arranged near the opening and extending toward the opening with respect to the axial direction of the stacking wheel, and the blades may deform in the axial direction of the stacking wheel by contacting the blade guiding member before the blades arrive at the opening when the stacking wheel rotates in the feeding-out direction of the paper sheet from the stacking unit.

In the paper sheet stacking and feeding apparatus of the present invention, the blades may be bent by contacting the blade guiding member when the stacking wheel rotates in the feeding-out direction of the paper sheet from the stacking unit and do not enter into the transport path.

In the paper sheet stacking and feeding apparatus of the present invention, the blades may be bent by contacting the paper-sheet guiding member when the stacking wheel rotates in the feeding-out direction of the paper sheet from the stacking unit and do not enter into the transport path.

In the paper sheet stacking and feeding apparatus of the present invention, the blade guiding member may be a plate member inclined to a surface that is parallel to the axial direction of the stacking wheel and a surface that is orthogonal to the axial direction.

In the paper sheet stacking and feeding apparatus of the present invention, the blade guiding member may block a portion of the opening in the paper-sheet guiding member, when seen along a direction that is at a right angle to the axial direction of the stacking wheel.

In the paper sheet stacking and feeding apparatus of the present invention, the blade guiding member may be arranged at a position where, when the stacking wheel rotates in the feeding-out direction of the paper sheet from the stacking unit, the blades of the stacking wheel contact the blade guiding member just before the blades arrive at the opening in the paper-sheet guiding member from a region on one side of the paper-sheet guiding member with the transport path present on the other side.

In the paper sheet stacking and feeding apparatus of the present invention, the opening in the paper-sheet guiding member may have a region through which a part of the blades of the stacking wheel that has been bent by contacting the blade guiding member passes, when the stacking wheel rotates in the feeding-in direction of the paper sheet toward the stacking unit.

A paper sheet handling device of the present invention is a paper sheet handling device, including: a stacking unit that stacks a paper sheet and provided with a paper-sheet feeding-out mechanism that feeds out the paper sheet stacked in the stacking unit one by one; a transport path along which the paper sheet passes during both of stacking the paper sheet in the stacking unit and feeding out the paper sheet from the stacking unit; a paper-sheet guiding member that guides the paper sheet so that the paper sheet is transported along the transport path, a stacking wheel that is rotatable in both of a feeding-in direction of the paper sheet toward the stacking unit and a feeding-out direction of the paper sheet from the stacking unit, the stacking wheel having a plurality of elastic blades on an outer circumferential surface thereof; an opening arranged to the paper-sheet guiding member so that the blades of the stacking wheel pass through the opening; a blade guiding member that guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

In the paper sheet handling device of the present invention, the opening may be arranged so that the blades do not pass through the opening when the stacking wheel rotates in the feeding-out direction of the paper sheet from the stacking unit.

In the paper sheet handling device of the present invention, the blade guiding member may include a tip end portion arranged near the opening and extending toward the opening with respect to the axial direction of the stacking wheel, and the blades may deform in the axial direction of the stacking wheel by contacting the blade guiding member before the blades arrive at the opening when the stacking wheel rotates in the feeding-out direction of the paper sheet from the stacking unit.

In the paper sheet handling device of the present invention, the blades may be bent by contacting the blade guiding member when the stacking wheel rotates in the feeding-out direction of the paper sheet from the stacking unit and do not enter into the transport path.

In the paper sheet handling device of the present invention, the blades may be bent by contacting the paper-sheet guiding member when the stacking wheel rotates in the feeding-out direction of the paper sheet from the stacking unit and do not enter into the transport path.

In the paper sheet handling device of the present invention, the blade guiding member may be a plate member inclined to a surface that is parallel to the axial direction of the stacking wheel and a surface that is orthogonal to the axial direction.

In the paper sheet handling device of the present invention, the blade guiding member may block a portion of the opening in the paper-sheet guiding member, when seen along a direction that is at a right angle to the axial direction of the stacking wheel.

In the paper sheet handling device of the present invention, the blade guiding member may be arranged at a position where, when the stacking wheel rotates in the feeding-out direction of the paper sheet from the stacking unit, the blades of the sticking wheel contact the blade guiding member just before the blades arrive at the opening in the paper-sheet guiding member from a region on one side of the paper-sheet guiding member with the transport path present on the other side.

In the paper sheet handling device of the present invention, the opening in the paper-sheet guiding member may have a region through which a part of the blades of the stacking wheel that has been bent by contacting the blade guiding member passes, when the stacking wheel rotates in the feeding-in direction of the paper sheet toward the stacking unit.

DESCRIPTION OF EMBODIMENT

Figure 1A:
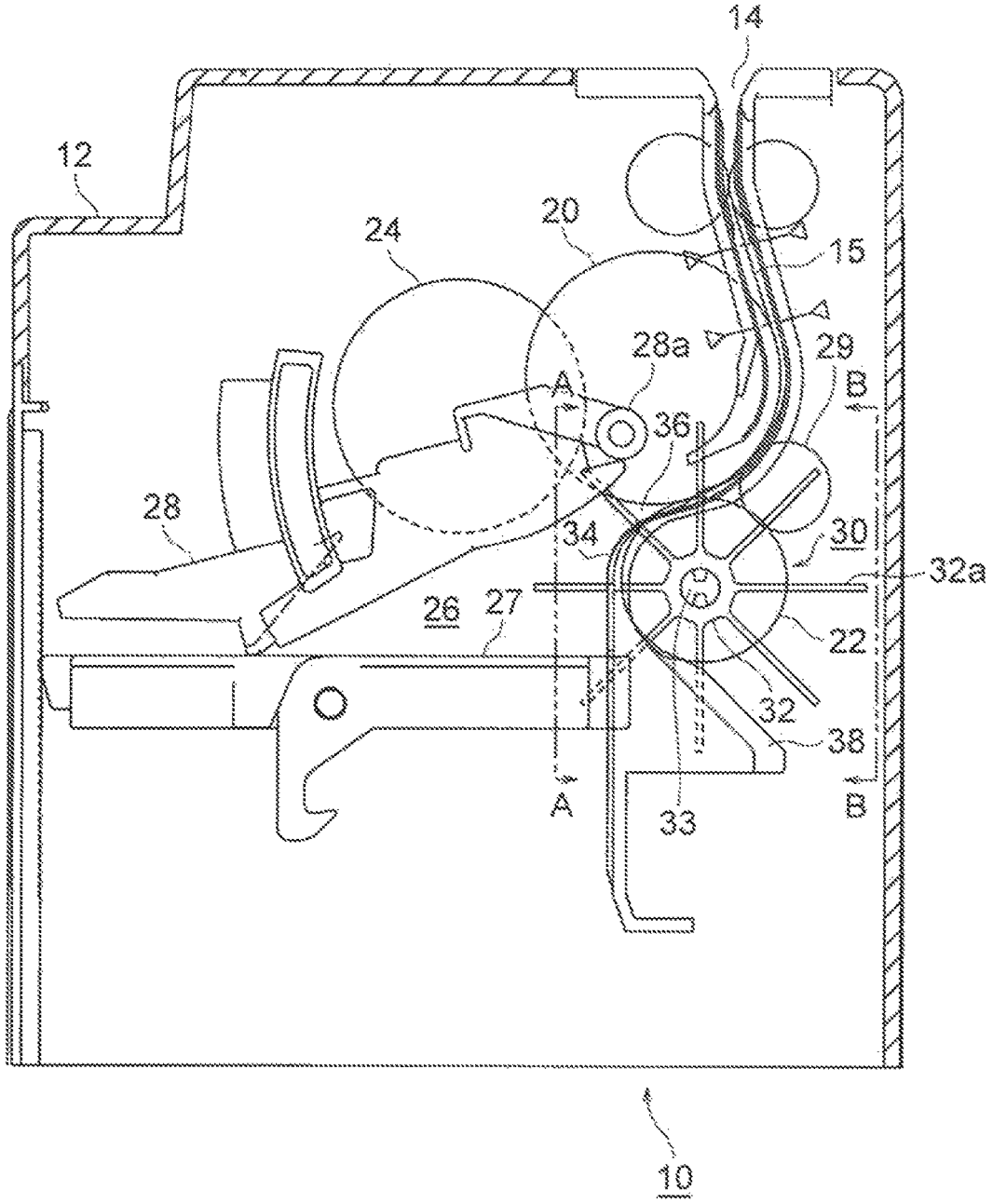
FIG. 1A is a schematic structural diagram of an internal structure of a paper sheet stacking and feeding apparatus according to an embodiment of the present invention.
Figure 1B:
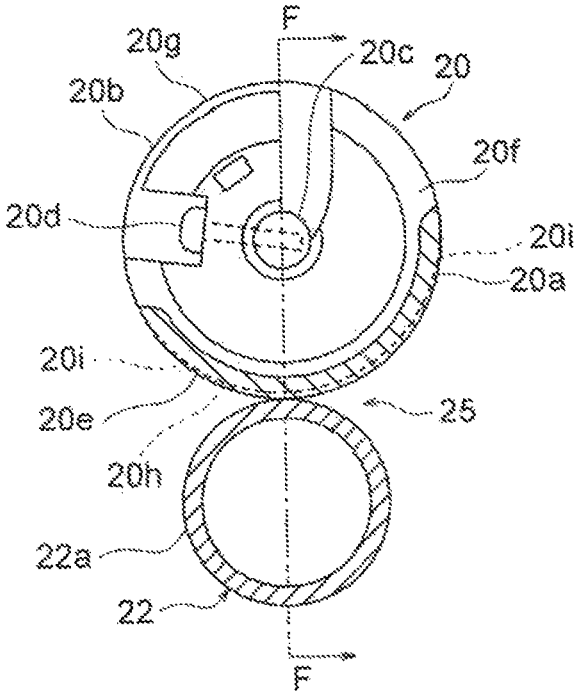
FIGS. 1B(a) and 1B(b) are structural diagrams of a feeding roller and a gate roller in the paper sheet stacking and feeding apparatus shown in FIG. 1A.
Figure 1B:
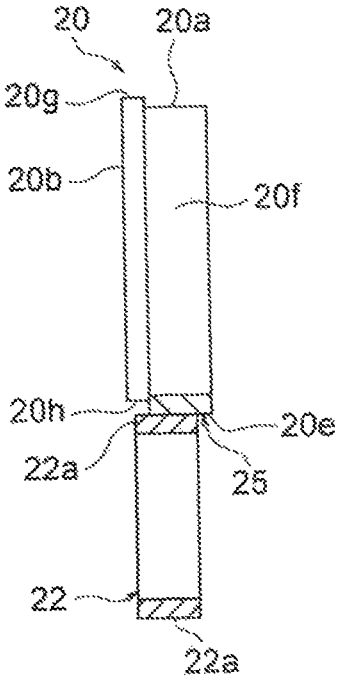
Figure 2:
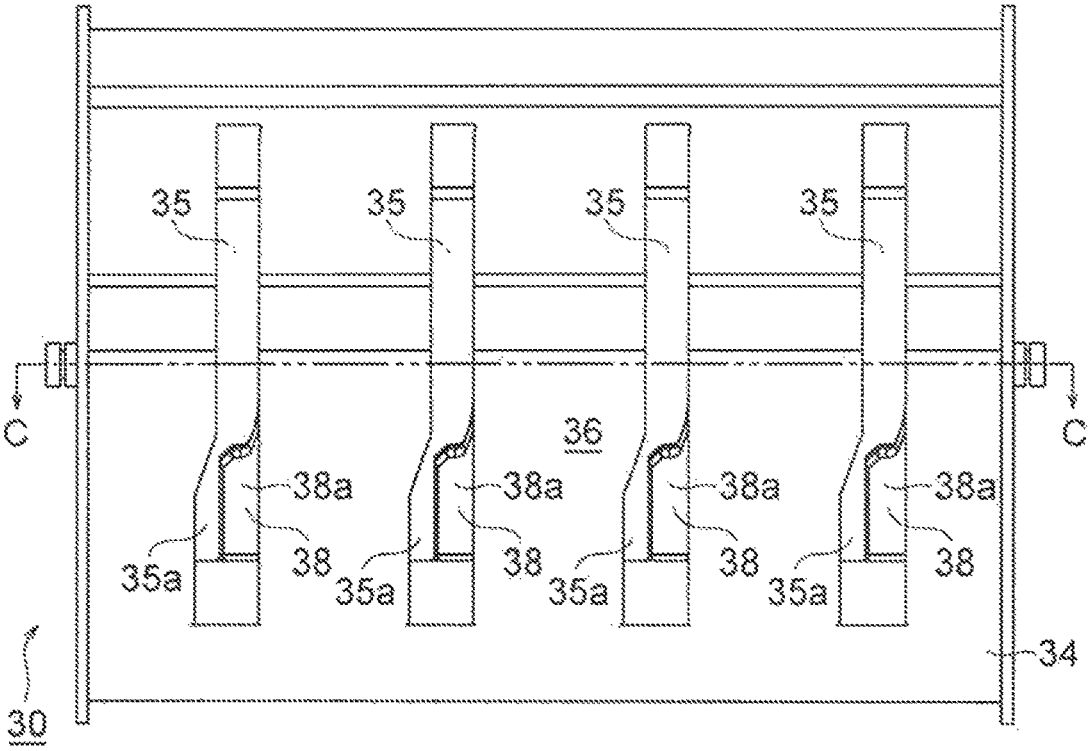
FIG. 2 is a side view, when seen along an arrow A-A, of a stacking wheel mechanism included in the paper sheet stacking and feeding apparatus shown in FIG. 1A, and is a side view of a structure of a paper-sheet guiding member and a blade guiding member in a state in which the stacking wheel is removed from the stacking wheel mechanism.
Figure 3:
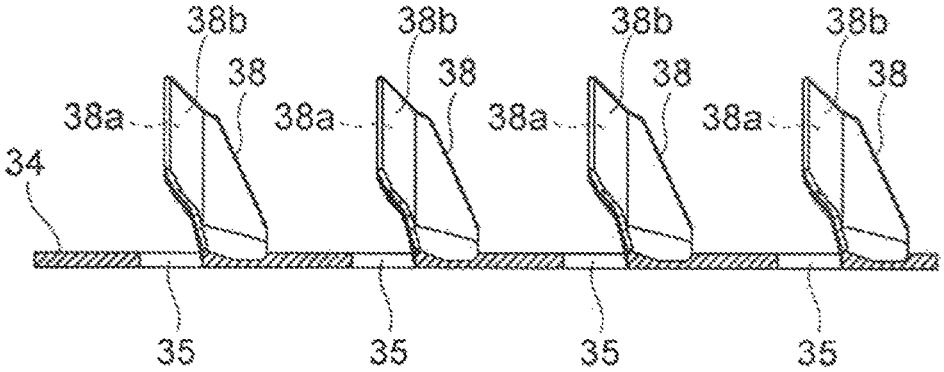
FIG. 3 is a structural diagram, when seen along an arrow C-C, of the paper-sheet guiding member and the blade guiding member shown in FIG. 2.
Figure 4:
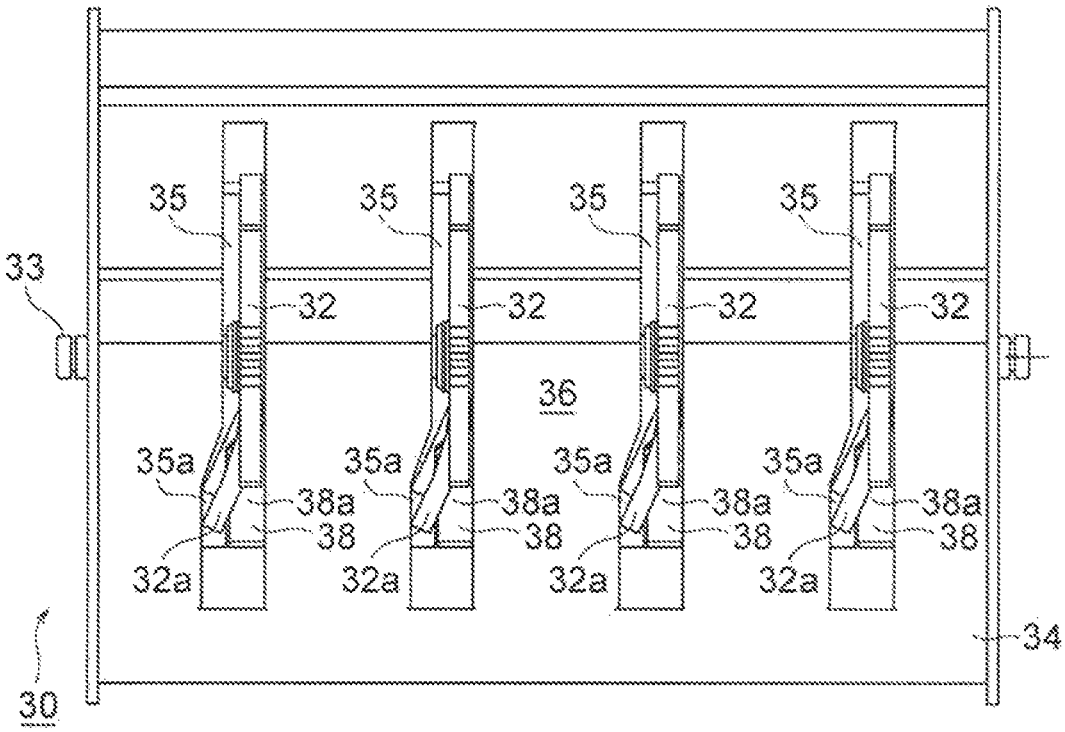
FIG. 4 is a side view, when seen along the arrow A-A, of the stacking wheel mechanism included in the paper sheet stacking and feeding apparatus shown in FIG. 1A and is a side view indicating a state of blades of the stacking wheel when the stacking wheel rotates in a feeding-in direction of the paper sheet toward a stacking unit.
Figure 5:
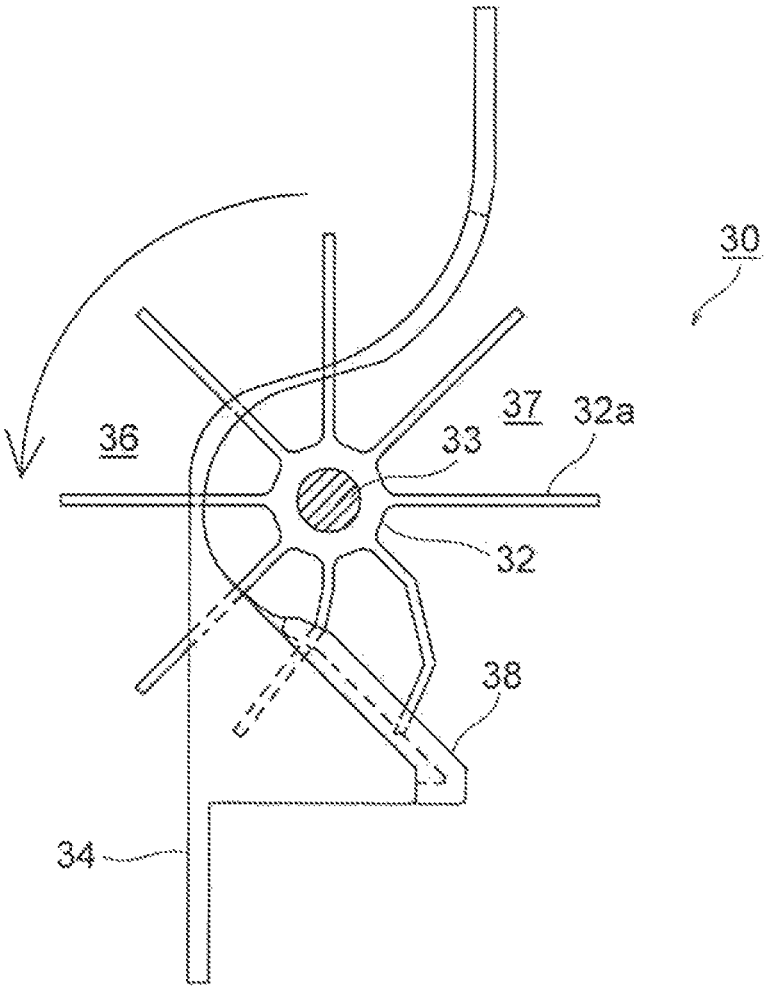
FIG. 5 is a side view of the stacking wheel when the stacking wheel rotates in the feeding-in direction of the paper sheet toward the stacking unit.
Figure 6:
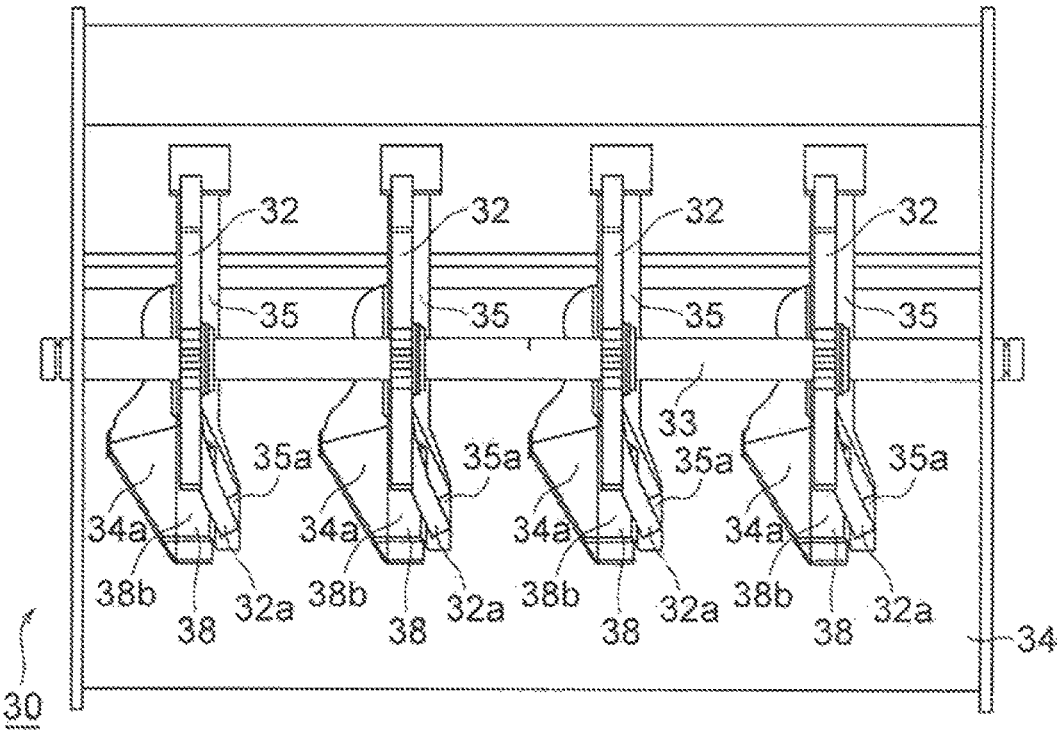
FIG. 6 is a side view, when seen along an arrow B-B, of the stacking wheel mechanism included in the paper sheet stacking and feeding apparatus shown in FIG. 1A, and is a side view indicating a state of the blades of the stacking wheel when the stacking wheel rotates in the feeding-in direction of the paper sheet toward the stacking unit.
Figure 7:
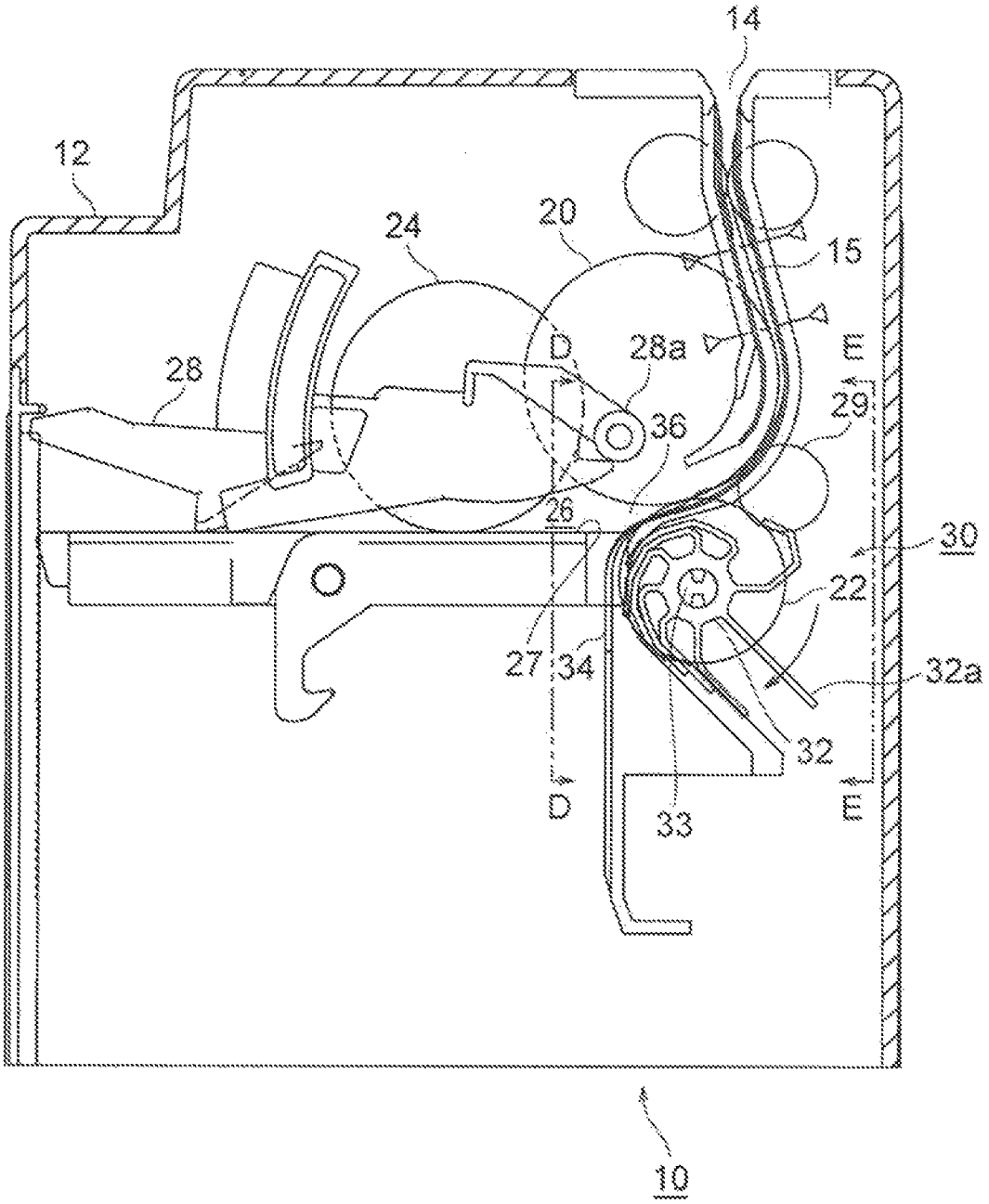
FIG. 7 is a schematic structural diagram of an internal structure of the paper sheet stacking and feeding apparatus when the stacking wheel rotates in a feeding-out direction of the paper sheet from the stacking unit.

Exemplary embodiments according to the present invention are explained below in detail while referring to the accompanying drawings. FIGS. 1A to 10 are views of a paper sheet stacking and feeding apparatus according to the present embodiment. Among these views, FIG. 1A is a schematic structural diagram of an internal structure of the paper sheet stacking and feeding apparatus according to the present embodiment, and FIGS. 1B(a) and 1B(b) are structural diagrams of a feeding roller and a gate roller included in the paper sheet stacking and feeding apparatus shown in FIG. 1A. Moreover, FIG. 2 is a side view, when seen along an arrow A-A, of a stacking wheel mechanism included in the paper sheet stacking and feeding apparatus shown in FIG. 1A, and is a side view of a structure of a paper-sheet guiding member and a blade guiding member in a state in which the stacking wheel is removed from the stacking wheel mechanism, and FIG. 3 is a structural diagram, when seen along an arrow C-C, of the paper-sheet guiding member and the blade guiding member shown in FIG. 2. FIGS. 4 to 6 are views indicating a state of blades of the stacking wheel when the stacking wheel rotates in a feeding-in direction of the paper sheet toward a stacking unit. Moreover, FIGS. 7 to 10 are views indicating a state of the blades of the stacking wheel when the stacking wheel rotates in a feeding-out direction of the paper sheet from the stacking unit.

The stacking wheel mechanism according to the present embodiment will be explained below. First, a structure of the paper sheet stacking and feeding apparatus equipped with the stacking wheel mechanism will be explained while referring to FIGS. 1A and 1B.

As shown in FIG. 1A, a paper sheet stacking and feeding apparatus 10 according to the present embodiment includes a housing 12; an inlet-outlet 14 for inserting paper sheets inside the housing 12 or discharging paper sheets from the housing 12, and a stacking unit 26 that stacks in layers the paper sheets inserted in the housing 12 from the inlet-outlet 14. The paper sheet stacking and feeding apparatus 10 is capable of performing an operation of transporting the paper sheets one by one from the paper sheets inserted in the housing 12 from the inlet-outlet 14 and stacking the paper sheets in the stacking unit 26, and an operation of feeding out the paper sheets one by one from the paper sheets in the stacking unit 26 and discharging the paper sheets outside the housing 12 from the inlet-outlet 14.

As shown in FIG. 1A, an inlet-side transport path 15 and an internal transport path 36 are arranged inside the housing 12 of the paper sheet stacking and feeding apparatus 10 in tandem such that a paper sheet passes through both of them when the paper sheet is stacked in the stacking unit 26 as well as when the paper sheet is fed out from the stacking unit 26. That is, a paper sheet inserted in the housing 12 from the inlet-outlet 14 is transported along the inlet-side transport path 15 and the internal transport path 36 in this order and then sent to the stacking unit 26. On the other hand, a paper sheet fed out from the stacking unit 26 is transported along the internal transport path 36 and the inlet-side transport path 15 in this order and then discharged outside the housing 12 from the inlet-outlet 14. Moreover, as shown in FIG. 1A, a paper-sheet guiding member 34 that guides a paper sheet so that the paper sheet is transported along the internal transport path 36 is arranged inside the housing 12 of the paper sheet stacking and feeding apparatus 10. The detailed structure of the paper-sheet guiding member 34 will be explained later.

The stacking unit 26 includes an elevator platform 27 capable of moving in an upward direction and a downward direction in FIG. 1A, and a note pressing member 28 arranged above the elevator platform 27. In the stacking unit 26, the paper sheets sent from the internal transport path 36 to the stacking unit 26 are stacked in layers on the elevator platform 27. In this process, when one paper sheet sent from the internal transport path 36 to the stacking unit 26 is stacked on the elevator platform 27, the elevator platform 27 is slightly lowered thereby preparing a stacking space for stacking the next paper sheet. On the other hand, in feeding out paper sheets from the stacking unit 26, when the paper sheets are fed out one by one from the stacking unit 26 to the internal transport path 36, the elevator platform 27 is slightly elevated so that the topmost paper sheet among the a plurality of paper sheets stacked on the elevator platform 27 comes in contact with a later-explained kicker roller 24. The note pressing member 28 is freely pivotable around an axis 28*a* arranged at a base end thereof. A spring, which can be a torsion spring and the like, is attached to the note pressing member 28 at a point of the axis 28*a*. By the action of this spring, the note pressing member 28 is biased toward the elevator platform 27 so as to rotate in the counterclockwise direction in FIG. 1A around the axis 28*a*. The a plurality of paper sheets stacked in layers on the elevator platform 27 are pressed from above by the note pressing member 28, whereby it is possible to prevent the troubles such as positional displacement and the like from occurring in the paper sheets on the elevator platform 27. In an alternative configuration according to the present embodiment, it is possible that the note pressing member 28 is not biased toward the elevator platform 27 by the spring but biased toward the elevator platform 27 by its own weight.

As shown in FIG. 1A, a feeding roller 20, a gate roller 22, and the kicker roller 24 are arranged inside the housing 12 of the paper sheet stacking and feeding apparatus 10. A pressure-type gate part (nip) is formed between the feeding roller 20 and the gate roller 22, and the paper sheets transported along the internal transport path 36 are separated one by one by this gate part. The detailed structure of the feeding roller 20, the gate roller 22, and the kicker roller 24 will be explained below.

The feeding roller 20 is capable of rotating in both of the clockwise direction and the counterclockwise direction in FIG. 1A. When sending a paper sheet, which is inserted in the housing 12 from the inlet-outlet 14, from the internal transport path 36 to the stacking unit 26, the feeding roller 20 rotates in the clockwise direction in FIG. 1A. This results in feeding out the paper sheet from the internal transport path 36 to the stacking unit 26. On the other hand, when the paper sheets are to be fed out one by one from the stacking unit 26 to the internal transport path 36, the feeding roller 20 rotates in the counterclockwise direction in FIG. 1A, and the paper sheets kicked by the later-explained kicker roller 24 toward the gate part are fed out one by one from the gate part toward the inlet-side transport path 15. A concrete structure of the feeding roller 20 is explained by using FIG. 1B. FIG. 1B(a) is a structural diagram of the feeding roller 20 and the later-explained gate roller 22, and FIG. 1B(b) is a view of the feeding roller 20 and the gate roller 22 when seen along an arrow F-F shown in FIG. 1B(a). As shown in FIG. 1B, the feeding roller 20 includes a first feeding roller part 20*a* and a second feeding roller part 20*b* that are substantially disk shaped and arranged such that their surfaces are adjacent to each other. The first feeding roller part 20*a* and the second feeding roller part 20*b* are arranged concentrically, and the first feeding roller part 20*a* and the second feeding roller part 20*b* rotate around one axis 20*c*. The first feeding roller part 20*a* is detachably attached to the axis 20*c* by with a screw 20*d*. On the other hand, the second feeding roller part 20*b* is firmly fixed to the axis 20*c*. A rubber member 20*e* is arranged in a part in a circumferential direction of an outer circumferential surface of the first feeding roller part 20*a*. A paper sheet sent to the gate part (shown by a reference numeral 25 in FIG. 1B) between the feeding roller 20 and the gate roller 22 is fed out from the gate part by the rubber member 20*e*. The part of the first feeding roller part 20*a* other than where the rubber member 20*e* is arranged functions as a supporting member 20*f* to support the rubber member 20*e*. The supporting member 20*f* is formed of a material, such as plastic or metal, having a coefficient of friction lower than that of the rubber member 20*e*. The second feeding roller part 20*b* is substantially disk shaped and formed of a material having a coefficient of friction lower than that of the rubber member 20*e* of the first feeding roller part 20*a*. The second feeding roller part 20*b* includes a first outer circumferential part 20*g* that is an outer circumferential surface having a relatively larger diameter (distance from a center of the axis 20*c*), a second outer circumferential part 20*h* having a diameter smaller than the first outer circumferential part 20*g*, and two inclined parts 20*i* arranged between the first outer circumferential part 20*g* and the second outer circumferential part 20*h*. The diameter of the first outer circumferential part 20*g* is either substantially equal to the diameter of the supporting member 20*f* of the first feeding roller part 20*a* or slightly larger than the diameter of the supporting member 20*f*. On the other hand, because the diameter of the inclined parts 20*i* gradually decreases, the diameter of the second outer circumferential part 20*h* is smaller than the diameter of the rubber member 20*e* of the first feeding roller part 20*a*. As a substitute for the feeding roller 20 having the structure shown in FIG. 1B, a friction member formed of a rubber material and the like can be provided on the entire outer circumferential surface of the feeding roller 20.

The gate roller 22 is pressure fit with the feeding roller 20. A rubber member 22*a* is arranged on the entire outer circumferential surface of the gate roller 22. As explained above, the gate part 25 (see FIG. 1B) is formed between the rubber member 22*a* arranged on the outer circumferential surface of the gate roller 22 and the rubber member 20*e* arranged on the outer circumferential surface of the first feeding roller part 20*a* of the feeding roller 20. A one-way clutch (not shown) is arranged in the gate roller 22. By the action of this one-way clutch, the gate roller 22 is able to rotate only in an opposite direction of the feeding-out direction of the paper sheet. Therefore, when stacking a paper sheet in the stacking unit 26, by rotating the feeding roller 20 in the feeding-in direction of the paper sheet, the gate roller 22 rotates in the feeding-in direction of the paper sheet accompanying the rotation of the feeding roller 20. On the other hand, when feeding out a paper sheet from the stacking unit 26, the gate roller does not rotate in the feeding-out direction of the paper sheet because the one-way clutch is arranged in the gate roller 22. With this arrangement, when feeding out paper sheets from the stacking unit 26, the paper sheets can be separated one by one by the gate part 25 between the feeding roller 20 and the gate roller 22.

A friction member, which can be a rubber member and the like, is formed in a part in a circumferential direction of an outer circumferential surface of the kicker roller 24. When feeding out the paper sheets one by one from the stacking unit 26 to the internal transport path 36, the kicker roller 24 rotates in the counterclockwise direction in FIG. 1A. The kicker roller 24 rotates while contacting the topmost paper sheet among the plurality of paper sheets stacked in layers on the elevator platform 27. By the action of the friction member arranged on the kicker roller 24, the topmost paper sheet is kicked toward the gate part 25 formed between the feeding roller 20 and the gate roller 22.

Moreover, as shown in FIG. 1A, a guiding roller 29 is pressure fit with the feeding roller 20. The guiding roller 29 rotates accompanying the rotation of the feeding roller 20. Accordingly, the paper sheets can be guided by a nip between the feeding roller 20 and the guiding roller 29. In an alternative configuration according to the present embodiment, instead of pressure fitting the guiding roller 29 directly to the feeding roller 20, the guiding roller 29 can be pressure fit to a not-shown auxiliary roller that is arranged on the rotation axis of the feeding roller 20 and that has the same diameter as the feeding roller 20.

As shown in FIG. 1A, a stacking wheel mechanism 30 is arranged near the gate roller 22 of the paper sheet stacking and feeding apparatus 10 according to the present embodiment. This stacking wheel mechanism 30 is arranged on the rotation axis of the gate roller 22. A stacking wheel 32 having a plurality of elastic blades 32*a* is arranged on an outer circumferential surface of the stacking wheel mechanism 30. The stacking wheel 32 is capable of rotating in both the directions of the feeding-in direction (that is, the counterclockwise direction in FIG. 1A) of the paper sheet toward the stacking unit 26 and the feeding-out direction (that is, the clockwise direction in FIG. 1A) of the paper sheet from the stacking unit 26. Although only one stacking wheel 32 can be seen in FIG. 1A, in reality, as shown in FIG. 4 and the like, a plurality of (for example, four) such stacking wheels 32 are provided in the stacking wheel mechanism 30 along a line that is parallel to the transportation direction (the upward direction and the downward direction in FIG. 4) of the paper sheet in the internal transport path 36. When transporting the paper sheets, which are inserted from the inlet-outlet 14 inside the housing 12, and stacking them one by one in the stacking unit 26, the stacking wheel 32 is rotated in the counterclockwise direction in FIG. 1A. With this, the tip end portions of the blades 32*a* of the stacking wheels 32 contact the surface of the paper sheet transported along the internal transport path 36, whereby the paper sheet is surely sent to the stacking unit 26 by the blades 32*a*. In the present embodiment, the structure is not necessarily limited to the one in which the stacking wheel mechanism 30 is arranged on the rotation axis of the gate roller 22, but in a modification example of the paper sheet stacking and feeding apparatus 10, it is allowable that the stacking wheel mechanism 30 is not arranged on the rotation axis of the gate roller 22.

As shown in FIG. 1A and the like, an axis 33 of the stacking wheel 32 is arranged on one side and the internal transport path 36 is arranged on the other side of the paper-sheet guiding member 34. As shown in FIGS. 2 and 3, a plurality of openings 35 are provided in the paper-sheet guiding member 34 corresponding to the stacking wheels 32 such that the blades 32*a* of each stacking wheel 32 can pass through the corresponding opening 35. As explained above, FIG. 2 is a side view, when seen along the arrow A-A, of the stacking wheel mechanism 30 included in the paper sheet stacking and feeding apparatus 10 shown in FIG. 1A, and is a side view of a structure of the paper-sheet guiding member 34 in a state in which the stacking wheel 32 is removed from the stacking wheel mechanism 30. Moreover, FIG. 3 is a structural diagram, when seen along the arrow C-C, of the paper-sheet guiding member 34 shown in FIG. 2. Because the a plurality of openings 35 are formed in the paper-sheet guiding member 34 such that each opening corresponds to each stacking wheel 32, even if the axis 33 of the stacking wheel 32 is arranged on one side and the internal transport path 36 is arranged on the other side of the paper-sheet guiding member 34, the blades 32*a* of the stacking wheels 32 can enter into the internal transport path 36 by passing through the openings 35 (see FIG. 5 and the like).

In the present embodiment, as shown in FIG. 4 and the like, a blade guiding member 38 is arranged near each stacking wheel 32 of the stacking wheel mechanism 30. The blade guiding member 38 guides the blades 32*a* of the corresponding stacking wheel 32. Each blade guiding member 38 guides the blades 32*a* of the corresponding stacking wheel 32 such that the blades 32*a* of the stacking wheel 32 enter into the transport path 36 by passing through the opening 35 in the paper-sheet guiding member 34 when the stacking wheel 32 rotates in the feeding-in direction (the counterclockwise direction in FIG. 1A) of the paper sheet toward the stacking unit 26, and the blades 32*a* of the stacking wheel 32 retreat from the transport path 36 when the stacking wheel 32 rotates in the feeding-out direction (the clockwise direction in FIG. 1A) of the paper sheet from the stacking unit 26. To explain in more detail, when the stacking wheel 32 rotates in the feeding-out direction (the clockwise direction in FIG. 1A) of the paper sheet from the stacking unit 26, the blade guiding member 38 guides the blades 32*a* of the stacking wheel 32 such that the blades 32*a* contact a surface of the paper-sheet guiding member 34 (the right surface in FIG. 1A) that is on the other side of the side on which the transport path 36 is present, so that the blades 32*a* do not pass through the opening 35 in the paper-sheet guiding member 34. The detailed structure of the blade guiding member 38 will be explained later.

As shown in FIGS. 2 and 3, each blade guiding member 38 is a plate-like member. A base part of the blade guiding member 38 is fixed to the paper-sheet guiding member 34 near the opening 35 in the paper-sheet guiding member 34. The tip end portion of the blade guiding member 38 extends toward the opening 35 in the paper-sheet guiding member 34 with respect to an axial direction (that is, left-right direction in FIGS. 2 and 3) of the stacking wheel 32. In other words, when seen along a direction that is at the right angle to the axial direction of the stacking wheel 32, that is, when seen along a left-right direction in FIG. 1A, as shown in FIG. 2, the blade guiding member 38 blocks a portion of the opening 35 in the paper-sheet guiding member 34. Accordingly, when the stacking wheel 32 rotates, irrespective of whether the stacking wheel 32 rotates in the feeding-in direction (the counterclockwise direction in FIG. 1A) of the paper sheet toward the stacking unit 26 or in the feeding-out direction (the clockwise direction in FIG. 1A) of the paper sheet from the stacking unit 26, the blades 32*a* of the stacking wheel 32 always contact the surface of the blade guiding member 38 corresponding to the stacking wheel 32.

The plate-like blade guiding member 38 is inclined to a surface that is parallel to the axial direction (that is, the left-right direction in FIGS. 2 and 3) of the stacking wheel 32 as well as a surface that is orthogonal to this axial direction. Accordingly, as shown in FIG. 2 and the like, each blade guiding member 38 is inclined with respect to the opening 35 in the paper-sheet guiding member 34. Moreover, each blade guiding member 38 is arranged such that, when the stacking wheel 32 rotates in the feeding-in direction (the counterclockwise direction in FIG. 1A) of the paper sheet toward the stacking unit 26, the blades 32*a* of the stacking wheel 32 contact one surface 38*a* (the surface toward the reader in FIG. 2) of the blade guiding member 38. In addition, each blade guiding member 38 is arranged such that, when the stacking wheel 32 rotates in the feeding-out direction (the clockwise direction in FIG. 1A) of the paper sheet from the stacking unit 26, the blades 32*a* of the stacking wheel 32 contact another surface 38*b* (the surface opposite of the one surface 38*a*) of the blade guiding member 38.

Figure 9:
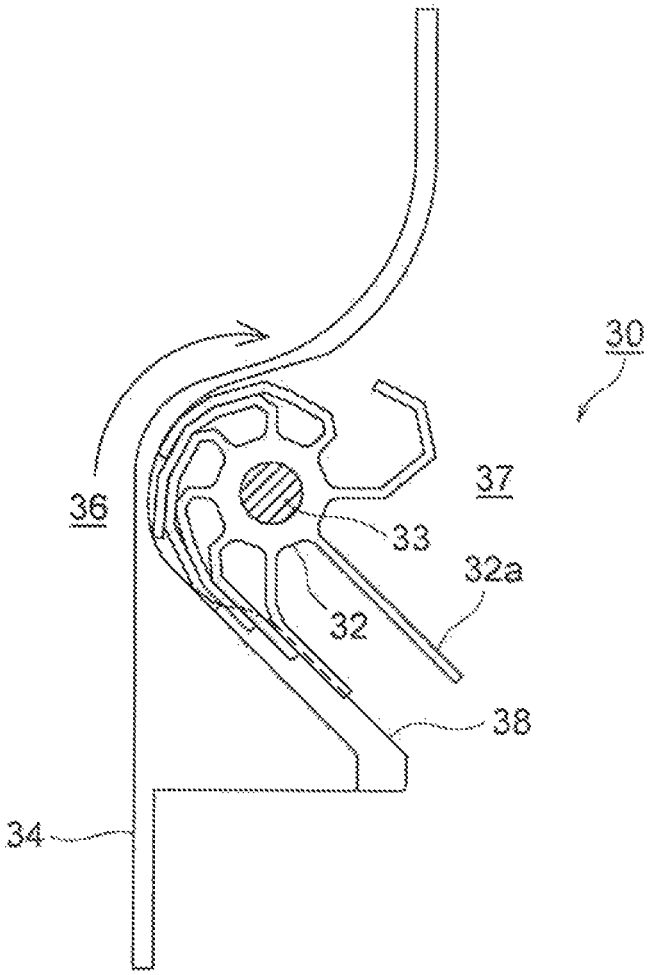
FIG. 9 is a side view of the stacking wheel when the stacking wheel rotates in the feeding-out direction of the paper sheet from the stacking unit.
Figure 10:
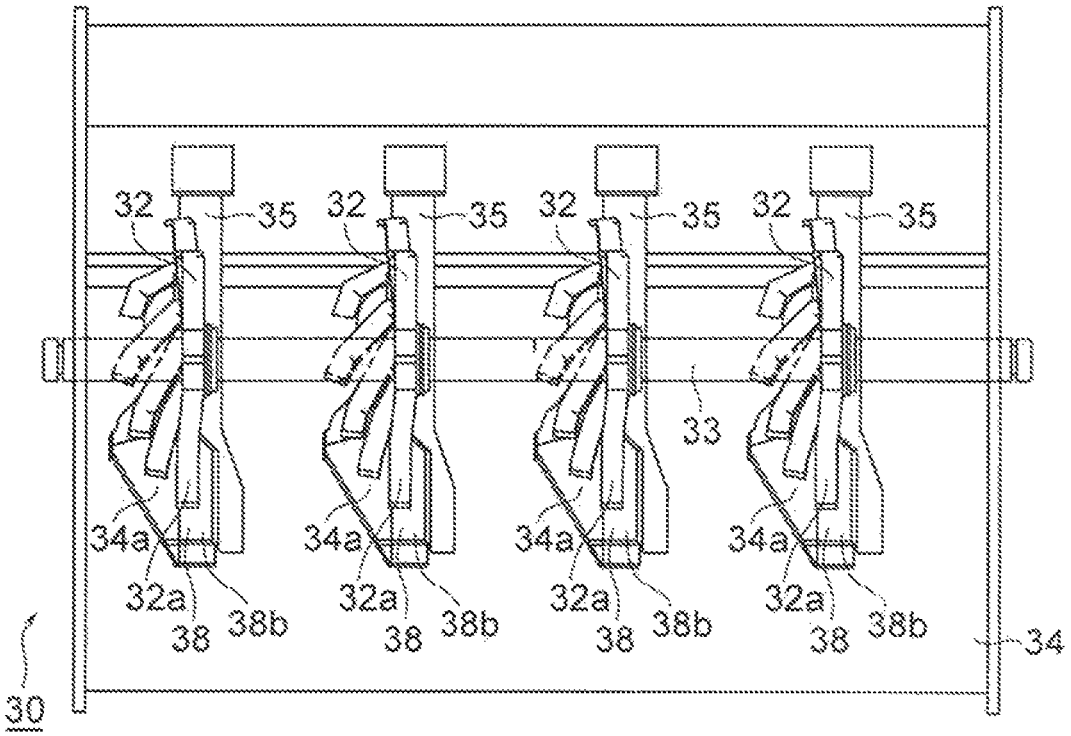
FIG. 10 is a side view, when seen along an arrow E-E, of the stacking wheel mechanism included in the paper sheet stacking and feeding apparatus shown in FIG. 7, and is a side view indicating a state of the blades of the stacking wheel when the stacking wheel rotates in the feeding-out direction of the paper sheet from the stacking unit.

As shown in FIG. 9, each blade guiding member 38 is arranged at such a position that, when the stacking wheel 32 rotates in the feeding-out direction (the clockwise direction in FIG. 9) of the paper sheet from the stacking unit 26, the blades 32*a* contact the blade guiding member 38 just before the blades 32*a* of the stacking wheel 32 arrive at the opening 35 in the paper-sheet guiding member 34 from a region 37 (a region on the side on which the axis 33 of the stacking wheel 32 is present) on the backside of the paper-sheet guiding member 34. As explained above, FIG. 9 is a side view of the stacking wheel 32 when the stacking wheel 32 rotates in the feeding-out direction of the paper sheet from the stacking unit 26. With such a configuration, when the stacking wheel 32 rotates in the feeding-out direction of the paper sheet from the stacking unit 26, just before the blades 32*a* of the stacking wheel 32 arrive at the opening 35 in the paper-sheet guiding member 34 from the region 37 on the backside of the paper-sheet guiding member 34, as shown in FIG. 10, the blades 32*a* contact the blade guiding member 38 and are bent, and the tip end portions of the blades 32*a* of the stacking wheel 32 deform in the axial direction (concretely, the left direction in FIG. 10) of the stacking wheel 32. The tip end portions of the blades 32*a* that have deformed in the axial direction of the stacking wheel 32 do not enter into the opening 35 in the paper-sheet guiding member 34, instead they are guided such that they contact a surface 34*a* of the paper-sheet guiding member 34 that is on the other side of the side on which the transport path 36 is present. In this manner, when the stacking wheel 32 rotates in the feeding-out direction of the paper sheet from the stacking unit 26, the blades 32*a* of the stacking wheel 32 do not pass through the opening 35 in the paper-sheet guiding member 34, whereby the blades 32*a* do not enter into the internal transport path 36.

The operations of the paper sheet stacking and feeding apparatus 10 having the above-mentioned structure, particularly, the operations of the stacking wheel mechanism 30, are explained below.

In the paper sheet stacking and feeding apparatus 10, when performing an operation of transporting and stacking the paper sheets, which are inserted in the housing 12 from the inlet-outlet 14. In the stacking unit 26 one by one, the stacking wheel 32 is rotated in the counterclockwise direction in FIG. 1A. A state of the blades 32*a* of the stacking wheel 32 during this operation is explained by using FIGS. 4 to 6. As explained above, FIG. 4 is a side view, when seen along the arrow A-A, of the stacking wheel mechanism 30 included in the paper sheet stacking and feeding apparatus 10 shown in FIG. 1A, and is a side view indicating a state of the blades 32*a* of the stacking wheel 32 when the stacking wheel 32 rotates in the feeding-in direction of the paper sheet toward the stacking unit 26. FIG. 5 is a side view of the stacking wheel 32 when the stacking wheel 32 rotates in the feeding-in direction of the paper sheet toward the stacking unit 26. Moreover, FIG. 6 is a side view, when seen along an arrow B-B, of the stacking wheel mechanism 30 included in the paper sheet stacking and feeding apparatus 10 shown in FIG. 1A, and is a side view indicating a state of the blades 32*a* of the stacking wheel 32 when the stacking wheel 32 rotates in the feeding-in direction of the paper sheet toward the stacking unit 26.

When the stacking wheel 32 rotates in the feeding-in direction (the counterclockwise direction in FIG. 1A) of the paper sheet toward the stacking unit 26, as shown in FIG. 5, the blades 32*a* of the stacking wheel 32 enter into the internal transport path 36 by passing through the opening 35 in the paper-sheet guiding member 34. The blades 32*a* that have entered into the internal transport path 36, when returning to the region 37 on the backside of the paper-sheet guiding member 34 after passing again through the opening 35 in the paper-sheet guiding member 34, as shown in FIG. 4, contact the one surface 38*a* of the plate-like blade guiding member 38 and are bent. Because the plate-like blade guiding member 38 is inclined to the surface that is parallel to the axial direction (that is, the left-right direction in FIGS. 2 and 3) of the stacking wheel 32 as well as the surface that is orthogonal to this axial direction, the tip end portions of the blades 32*a*, which contact the blade guiding member 38, deform in the axial direction (concretely, the left direction in FIG. 4) of the stacking wheel 32. As shown in FIG. 4 or 6, the opening 35 in the paper-sheet guiding member 34 has a region 35*a* through which the part of the blades 32*a* of the stacking wheel 32 that has been bent by contacting the blade guiding member 38 passes when the stacking wheel 32 rotates in the feeding-in direction of the paper sheet toward the stacking unit 26. Accordingly, even if the tip end portions of the blades 32*a* deform in the axial direction of the stacking wheel 32 by contacting the blade guiding member 38, because the tip end portions of the blades 32*a* enter, as shown in FIG. 4, into the region 35*a* of the opening 35, it is prevented that the tip end portions of the blades 32*a* collide with the paper-sheet guiding member 34. Accordingly, abrasion of the tip end portions of the blades 32*a* can be suppressed.

In this manner, when the stacking wheel 32 rotates in the feeding-in direction of the paper sheet toward the stacking unit 26, the blades 32*a* of the stacking wheel 32 enter into the internal transport path 36 after passing through the opening 35 in the paper-sheet guiding member 34. The blades 32*a* that have entered into the internal transport path 36, when, returning to the region 37 on the backside of the paper-sheet guiding member 34 after passing again through the opening 35 in the paper-sheet guiding member 34, contact the one surface 38*a* of the plate-like blade guiding member 38 and are bent. By such movement of the blades 32*a* of the stacking wheel 32, the tip end portions of the blades 32*a* of the stacking wheel 32 can be caused to contact the surface of the paper sheet transported along the internal transport path 36 and the paper sheet can be surely sent to the stacking unit 26 by the blades 32*a*.

Figure 8:
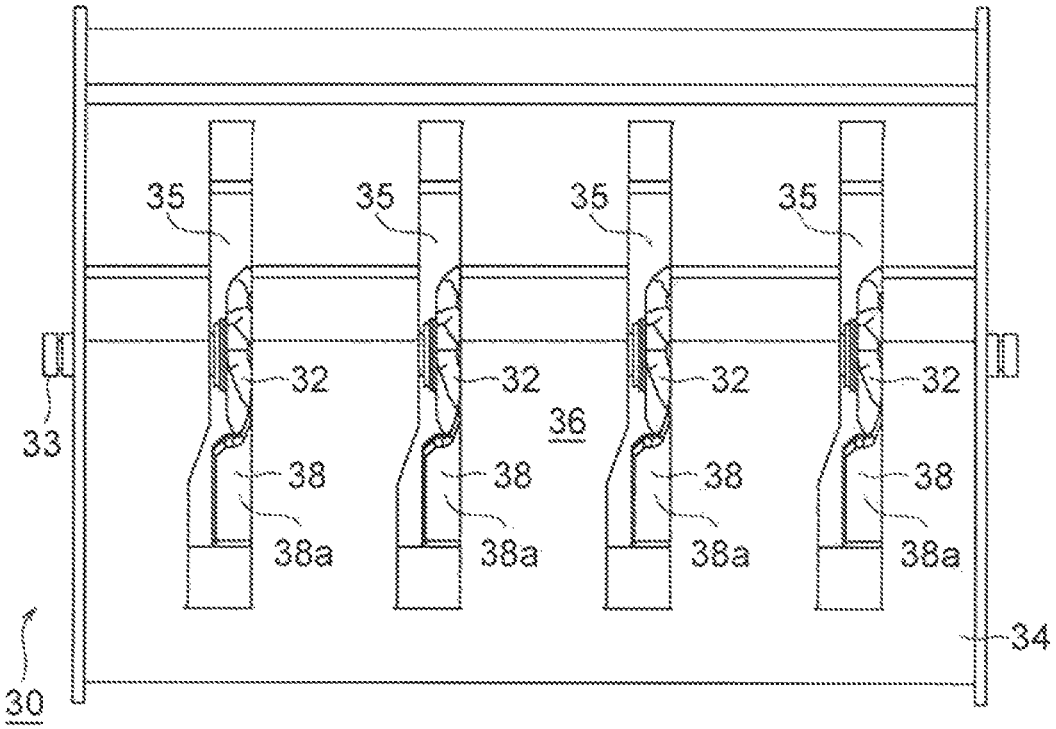
FIG. 8 is a side view, when seen along an arrow D-D, of the stacking wheel mechanism included in the paper sheet stacking and feeding apparatus shown in FIG. 7, and is a view indicating a state of the blades of the stacking wheel when the stacking wheel rotates in the feeding-out direction of the paper sheet from the stacking unit.

On the other hand, in the paper sheet stacking and feeding apparatus 10, when performing the operation of feeding out the paper sheets one by one from the stacking unit 26 and discharging them outside the housing 12 from the inlet-outlet 14, the stacking wheel 32 rotates in the clockwise direction in FIG. 1A. The state of the blades 32*a* of the stacking wheel 32 at this time will be explained by using FIGS. 7 to 10. As explained above, FIG. 7 is a schematic structural diagram of an internal structure of the paper sheet stacking and feeding apparatus 10 according to the present embodiment when the stacking wheel 32 rotates in the feeding-out direction of the paper sheet from the stacking unit 26. FIG. 8 is a side view, when seen along an arrow D-D, of the stacking wheel mechanism 30 included in the paper sheet stacking and feeding apparatus 10 shown in FIG. 7, and is a view indicating the state of the blades 32*a* of the stacking wheel 32 when the stacking wheel 32 rotates in the feeding-out direction of the paper sheet from the stacking unit 26. FIG. 9 is a side view of the stacking wheel 32 when the stacking wheel 32 rotates in the feeding-out direction of the paper sheet from the stacking unit 26. Moreover, FIG. 10 is a side view, when seen along an arrow E-E, of the stacking wheel mechanism 30 included in the paper sheet stacking and feeding apparatus 10 shown in FIG. 7, and is a side view indicating the state of the blades 32*a* of the stacking wheel 32 when the stacking wheel 32 rotates in the feeding-out direction of the paper sheet from the stacking unit 26.

As explained above, each blade guiding member 38 is arranged at the position where the blades 32*a* contact the blade guiding member 38 just before the blades 32*a* of the stacking wheel 32 arrive at the opening 35 in the paper-sheet guiding member 34 from the region 37 (the region on the side on which the axis 33 of the stacking wheel 32 is present) on the backside of the paper-sheet guiding member 34. Therefore, when the stacking wheel 32 rotates in the feeding-out direction (the clockwise direction in FIG. 7) of the paper sheet from the stacking unit 26, just before the blades 32*a* of the stacking wheel 32 arrive at the opening 35 in the paper-sheet guiding member 34 from the region 37 on the backside of the paper-sheet guiding member 34, as shown in FIG. 10, the blades 32*a* contact the blade guiding member 38 and are bent, and the tip end portions of the blades 32*a* deform in the axial direction (concretely, the left direction in FIG. 10) of the stacking wheel 32. The tip end portions of the blades 32*a* that have deformed in the axial direction of the stacking wheel 32 do not enter into the opening 35 in the paper-sheet guiding member 34, instead they are guided such that they contact the surface 34*a* of the paper-sheet guiding member 34 that is on the other side of the side on which the transport path 36 is present. In this manner, when the stacking wheel 32 rotates in the feeding-out direction of the paper sheet from the stacking unit 26, the blades 32*a* of the stacking wheel 32 do not pass through the opening 35, but move from the downward direction to the upward direction in FIG. 10 while contacting the surface 34*a* of the paper-sheet guiding member 34 that is on the other side of the side on which the transport path 36 is present. Therefore, as shown in FIGS. 8 and 9, the blades 32*a* do not enter into the internal transport path 36, and when feeding out the paper sheet from the stacking unit 26 to the internel transport path 36, because the blades 32*a* of the stacking wheel 32 have retreated from the internal transport path 36, it is prevented that the blades 32*a* of the stacking wheel 32 contact the paper sheets fed out one by one from the stacking unit 26.

According to the stacking wheel mechanism 30 having the above-explained structure, the paper sheet stacking and feeding apparatus 10 equipped with the stacking wheel mechanism 30, and the paper sheet handling method that uses the stacking wheel mechanism 30, the blade guiding member 38 is arranged near the stacking wheel 32 in the following manner. That is, the blade guiding member 38 guides the blades 32*a* of the stacking wheel 32 such that the blades 32*a* enter into the internal transport path 36 when the stacking wheel 32 rotates in the feeding-in direction of the paper sheet toward the stacking unit 26, and guides the blades 32*a* of the stacking wheel 32 such that the blades 32*a* retreat from the internal transport path 36 when the stacking wheel 32 rotates in the feeding-out direction of the paper sheet from the stacking unit 26. Therefore, when feeding out the paper sheets from the stacking unit 26, because the blades 32*a* of the stacking wheel 32 can be retreated from the internal transport path 30 without moving the stacking wheel 32, it is not necessary to provide a mechanism to move the stacking wheel 32, and cost reduction can be realized. Moreover, because a retreating space for retreating the stacking wheel 32 becomes needless, downsizing of the device can be realized.

Moreover, in the stacking wheel mechanism 30 according to the present embodiment, as explained above, when the stacking wheel 32 rotates in the feeding-out direction of the paper sheet from the stacking unit 26, the blades 32*a* of the stacking wheel 32 contact the blade guiding member 38 whereby the blades 32*a* are bent and retreated from the internal transport path 36 (FIGS. 9 and 10). Moreover, the blade guiding member 38 is configured such that the blades 32*a* of the stacking wheel 32 is deformed in the axial direction of the stacking wheel 32 when the stacking wheel 32 rotates in the feeding-cut direction of the paper sheet from the stacking unit 26 because the blades 32*a* of the stacking wheel 32 contact the blade guiding member 38 (see FIG. 10).

Moreover, in the stacking wheel mechanism 30 according to the present embodiment, as explained above, the blade guiding member 38 is a plate-like member inclined to the surface that is parallel to the axial direction of the stacking wheel 32 as well as the surface that is orthogonal to this axial direction (see FIG. 3). The blade guiding member 38 is configured such that, when the stacking wheel 32 rotates in the feeding-in direction of the paper sheet toward the stacking unit 26, the blades 32*a* of the stacking wheel 32 contact the one surface 38*a* of the blade guiding member 38 (see FIG. 4), and, when the stacking wheel 32 rotates in the feeding-out direction of the paper sheet from the stacking unit 26, the blades 32*a* of the stacking wheel 32 contact another surface 38*b* of the blade guiding member 38 (see FIG. 10).

Moreover, in the stacking wheel mechanism 30 according to the present embodiment, as explained above, the paper-sheet guiding member 34 is provided that guides the paper sheet such that the paper sheet is transported along the internal transport path 36, the axis 33 of the stacking wheel 32 is arranged on one side and the internal transport path 36 is arranged on the other side of the paper-sheet guiding member 34, and the blade guiding member 38 is firmly fixed to the paper-sheet guiding member 34 (see FIGS. 2 and 3). In an alternative configuration of the present embodiment, instead of firmly fixing the blade guiding member 38 to the paper-sheet guiding member 34, the blade guiding member 38 can be detachably attached to the paper-sheet guiding member 34 with a screw and the like. Moreover, the opening 35 through which the blades 32*a* of the stacking wheel 32 can pass is arranged in the paper-sheet guiding member 34. Therefore, when the stacking wheel 32 rotates in the feeding-in direction of the paper sheet toward the stacking unit 26, the blades 32*a* of the stacking wheel 32 enter into the internal transport path 36 after passing through the opening 35 in the paper-sheet guiding member 34 (see FIGS. 4 and 5). In contrast, when the stacking wheel 32 rotates in the feeding-out direction of the paper sheet from the stacking unit 26, the blades 32*a* of the stacking wheel 32 are guided such that they contact the surface (surface 34*a*) of the paper-sheet guiding member 34 that is on the other side of the side on which the internal transport path 36 is present, and the blades 32*a* of the stacking wheel 32 do not pass through the opening 35 in the paper-sheet guiding member 34 (see FIGS. 9 and 10).

Moreover, in the stacking wheel mechanism 30 according to the present embodiment, as explained above, the base part of the blade guiding member 38 is fixed to the paper-sheet guiding member 34 near the opening 35 in the paper-sheet guiding member 34. The tip end portion of the blade guiding member 38 extends toward the opening 35 in the paper-sheet guiding member 34 with respect to the axial direction of the stacking wheel 32 (see FIG. 3). When seen along a direction that is at the right angle to the axial direction of the stacking wheel 32, the blade guiding member 38 blocks a portion of the opening 35 in the paper-sheet guiding member 34 (see FIG. 2). The blade guiding member 38 is inclined with respect to the opening 35 in the paper-sheet guiding member 34 (see FIG. 3).

Moreover, in the stacking wheel mechanism 30 according to the present embodiment, as explained above, the blade guiding member 38 is arranged at such a position that, when the stacking wheel 32 rotates in the feeding-out direction of the paper sheet from the stacking unit 26, the blades 32*a* contact the blade guiding member 38 just before the blades 32*a* of the stacking wheel 32 arrive at the opening 35 in the paper-sheet guiding member 34 from the region 37 (the region on the other side of the paper-sheet guiding member 34 with the internal transport path 36 arranged on one side) on the backside of the paper-sheet guiding member 34 (see FIGS. 9 and 10). The opening 35 in the paper-sheet guiding member 34 has the region 35*a* through which the blades 32*a* of the stacking wheel 32 that have been bent by contacting the blade guiding member 38 pass when the stacking wheel 32 rotates in the feeding-in direction of the paper sheet toward the stacking unit 26 (see FIG. 4).

The stacking wheel mechanism 30, the paper sheet stacking and feeding apparatus 10 equipped with the stacking wheel mechanism 30, and the paper sheet handling method that uses the stacking wheel mechanism 30 according to the present embodiment are not limited to the one explained above, and can be modified in various manner.

For example, another surface 38*b* (see FIG. 10) of the blade guiding member 38, with which the blades 32*a* of the stacking wheel 32 contact when the stacking wheel 32 rotates in the feeding-out direction (the clockwise direction in FIG. 1A) of the paper sheet from the stacking unit 26, can be curved into a concave shape like a bowl. In this configuration, when the stacking wheel 32 rotates in the feeding-out direction of the paper sheet from the stacking unit 26, as shown in FIG. 10, the blades 32*a* are bent by contacting another surface 38*b* of the blade guiding member 38 just before the blades 32*a* of the stacking wheel 32 arrive at the opening 35 in the paper-sheet guiding member 34 from the region 37 on the backside of the paper-sheet guiding member 34. Because another surface 38*b* of the blade guiding member 38 is curved in the concave shape, the tip end portions of the blades 32*a* are received in the curved concave part of another surface 38*b*. In comparison with the case where another surface 38*b* of the blade guiding member 38 is flat plate-like, the tip end portions of the blades 32*a* are subjected to less abrasion and the stacking wheel 32 can be used for a longer term. Moreover, by receiving the tip end portions of the blades 32*a* in the curved concave part of another surface 38*b* of the blade guiding member 38, it is possible to prevent occurrence of trouble where the blades 32*a*, which have been bent, collapse and spread because of vibration, shock, and the like.

Moreover, a portion of the surface 34*a* (see FIG. 10) of the paper-sheet guiding member 34, which is on the other side of the side on which the internal transport path 38 is present, where the blades 32*a* of the stacking wheel 32 contact when the stacking wheel 32 rotates in the feeding-out direction of the paper sheet from the stacking unit 26, can be curved into a concave shape like a bowl. In this configuration, as explained above, when the stacking wheel 32 rotates in the feeding-out direction of the paper sheet from the stacking unit 26, just before the blades 32*a* of the stacking wheel 32 arrive at the opening 35 in the paper-sheet guiding member 34 from the region 37 on the backside of the paper-sheet guiding member 34, as shown in FIG. 10, the blades 32*a* are bent by contacting another surface 38*b* of the blade guiding member 38, and the tip end portions of the blades 32*a* deform along the axial direction of the stacking wheel 32 in the left direction in FIG. 10, and thereafter the blades 32*a* move in the upward direction in FIG. 10 while contacting the surface 34*a* of the paper-sheet guiding member 34. Because the portion of the surface 34*a* of the paper-sheet guiding member 34 where the blades 32*a* contact is curved in the concave shape, the tip end portions of the blades 32*a* are received in the curved concave part of the surface 34*a*. In comparison with the case where the surface 34*a* of the paper-sheet guiding member 34 is flat plate-like, the tip end portions of the blades 32*a* are subjected to less abrasion and the stacking wheel 32 can be used for a longer term. Moreover, by receiving the tip end portions of the blades 32*a* in the curved concave part of the surface 34*a* of the paper-sheet guiding member 34, it is possible to prevent occurrence of trouble where the blades 32*a*, which nave been bent, collapse and spread because of vibration, shock, and the like.

The paper sheet stacking and feeding apparatus equipped with the stacking wheel mechanism 30 according to the present embodiment is not limited to the one shown in FIG. 1A. For example, the stacking wheel mechanism 30 according to the present embodiment can be arranged in a money depositing and dispensing unit 120 in a banknote handling device 110 like the one shown in FIG. 11. A schematic structure of the banknote handling device 110 shown in FIG. 11 will be explained below.

Figure 11:
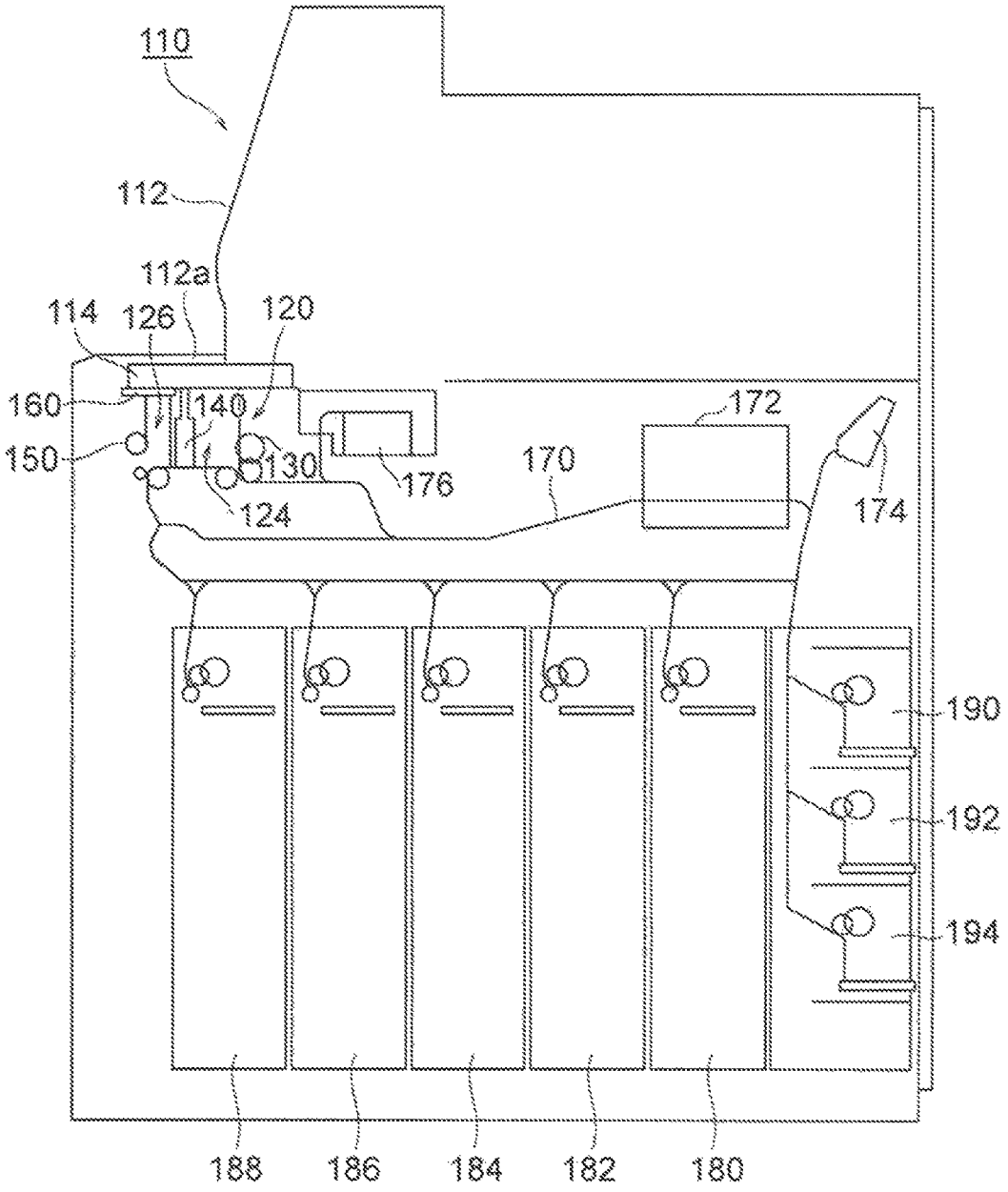
FIG. 11 is a schematic structural diagram of a banknote handling device that includes a money depositing and dispensing unit in which the stacking wheel mechanism according to the embodiment of the present invention is arranged.

The banknote handling device 110, which is equipped with the stacking wheel mechanism 30 according to the present embodiment, as shown in FIG. 11, includes a substantially box-shaped housing 112. A money depositing cassette 180, a deposited money escrow unit 182, and three money dispensing cassettes 184, 186, 188 are housed inside the housing 112. A transport unit 170 is housed inside the housing 112 of the banknote handling device 110. The transport unit 170 transports banknotes one by one within the housing 112. Three money dispensing trays 190, 192, 194 are housed inside the housing 112. Moreover, as shown in FIG. 11, the money depositing and dispensing unit 120 is arranged on the front side (the left side in FIG. 11) of the housing 112 of the banknote handling device 110, and this money depositing and dispensing unit 120 is used to deposit banknotes inside the housing 112 from outside and dispense banknotes from the inside of the housing 112 to the outside.

An opening 112*a* is arranged in the housing 112 at a position near the money depositing and dispensing unit 120. An operator can access the money depositing and dispensing unit 120 from the outside of the housing 112 through this opening 112*a*. An outer shutter 114 is arranged in the opening 112*a* in the housing 112. This outer shutter 114 is used to open or close the opening 112*a*. The money depositing and dispensing unit 120 includes a banknote stacking region. This banknote stacking region is partitioned into a money depositing region 124 and a money dispensing region 126 by a partition mechanism 140. The money depositing and dispensing unit 120 feeds out the banknotes stacked in the money depositing region 124 to the inside of the housing 112 by using a later-explained banknote feeding-out mechanism 130 to send the banknotes to the transport unit 170. The banknotes sent from the inside of the housing 112 by the transport unit 170 are stacked in the money dispensing region 126.

As shown in FIG. 11, inside the housing 112, the money depositing cassette 180, the deposited money escrow unit 182, and the three money dispensing cassettes 184, 186, 188 are arranged in tandem along a front-back direction (the let-right direction in FIG. 11) of the banknote handling device 110. The money depositing cassette 180, the deposited money escrow unit 182, and the money dispensing cassettes 184, 186, 188 are connected to the transport unit 170. Banknotes can be stacked in layers in the money depositing cassette 180, the deposited money escrow unit 182, and the money dispensing cassettes 184, 186, 188. Moreover, each of the money depositing cassette 180, the deposited money escrow unit 182, and the money dispensing cassettes 184, 186, 188 is provided with a banknote feeding-out mechanism. The banknote feeding-out mechanism feeds out the stored banknotes one by one to the transport unit 170.

A recognition unit 172 is arranged in the transport unit 170. The recognition unit 172 recognizes a denomination, authenticity, fitness, and the like of the banknotes transported by the transport unit 170. A mounting reject unit 174 is connected to the transport unit 170. When replenishing banknotes in the banknote handling device 110, the banknotes (rejected banknotes) that are recognized as being not normal banknotes by the recognition unit 172 are sent to the mounting reject unit 174 from the transport unit 170 and stacked therein. A dispensing reject unit 176 is connected to the transport unit 170. When dispensing banknotes from the banknote handling device 110, the banknotes (reject banknotes) that are recognized as being not genuine banknotes by the recognition unit 172 are sent to the dispensing reject unit 176 from the transport unit 170 and stacked therein.

A detailed structure of the money depositing and dispensing unit 120 will be explained below by using FIG. 12.

As explained above, the banknote stacking region in which the banknotes are stacked is formed on a mounting table 122 in the money depositing and dispensing unit 120. To explain in more detail, as shown in FIG. 12, the banknote stacking region is partitioned into the money depositing region 124 and the money dispensing region 126 by the partition mechanism 140. The banknotes that are to be inserted in the housing 112 of the banknote handling device 110 are stacked by the operator in the money depositing region 124 from the outside of the housing 112. On the other hand, the banknotes sent to the money depositing and dispensing unit 120 from inside of the housing 112 are stacked in the money dispensing region 126.

The banknote feeding-out mechanism 130 that feeds out banknotes stacked in the money depositing region 124 to the inside of the housing 112 is arranged on the side of the money depositing region 124 in the money depositing and dispensing unit 120. The banknote feeding-out mechanism 130 includes a kicker roller 131 that kicks in the downward direction the rightmost banknote in FIG. 12 among the banknotes that have been stacked in the money depositing region 124, a feeding roller 132 that feeds out the banknote, which was kicked in the downward direction by the kicker roller 131, to the inside of the housing 112 and sends the banknote to the transport unit 170, and a gate roller 133 arranged so as to be in contact with the feeding roller 132 to form a gate part (nip N) between the feeding roller 132. A feeding-out guide 134 that pivots around an axis 134*a* on which the feeding roller 132 is arranged is provided in the banknote feeding-out mechanism 130. Moreover, a gate leaver 135 and a gate-leaver operating link 136 are provided in the banknote feeding-out mechanism 130. The gate leaver 135 and the gate-leaver operating link 136 pivot integrally around an axis 137.

The partition mechanism 140, which partitions the banknote stacking region formed on the mounting table 122 in the money depositing and dispensing unit 120 into the money depositing region 124 and the money dispensing region 126, includes a depositing-side note pressing member 141 arranged on the side of the money depositing region 124, and a dispensing-side note pressing member 142 arranged on the side or the money dispensing region 126. The depositing-side note pressing member 141 and the dispensing-side note pressing member 142 are capable of independently moving in the left-right direction in FIG. 12 on the mounting table 122. Accordingly the width of the money depositing region 124 can be changed by moving the depositing-side note pressing member 141, and the width of the money dispensing region 126 can be changed by moving the dispensing-side note pressing member 142.

Moreover, a banknote taking-in mechanism 150 is provided on the side of the money dispensing region 126 in the money depositing and dispensing unit 120. The banknote taking-in mechanism 150 sends the banknotes from the inside of the housing 112 to the money dispensing region 126 and stacks the banknotes in the money dispensing region 126, and takes the banknotes stacked in the money dispensing region 126 to the inside of the housing 112. The banknote taking-in mechanism 150 includes a stacking leaver 151 capable of pivoting around an axis 151*a*, a feeding roller 152 arranged opposing the stacking leaver 151 and rotatable in the clockwise direction in FIG. 12, and a taking-in roller 153 arranged below the feeding roller 152 and rotatable in both the clockwise direction and the counterclockwise direction in FIG. 12. In the banknote taking-in mechanism 150, a guiding member 155 is arranged so as to extend in the upward direction and the downward direction and form the money dispensing region 126 between the dispensing-side note pressing member 142 of the partition mechanism 140.

In the banknote taking-in mechanism 150, an opposing roller 150 is provided in contact with the taking-in roller 153, and a nip is formed between the opposing roller 159 and the taking-in roller 153. The stacking wheel mechanism 30 according to the present embodiment is arranged near the opposing roller 159. To explain in more detail, the stacking wheel 32 of the stacking wheel mechanism 30 according to the present embodiment is arranged on the axis of the opposing roller 159.

Figure 12:
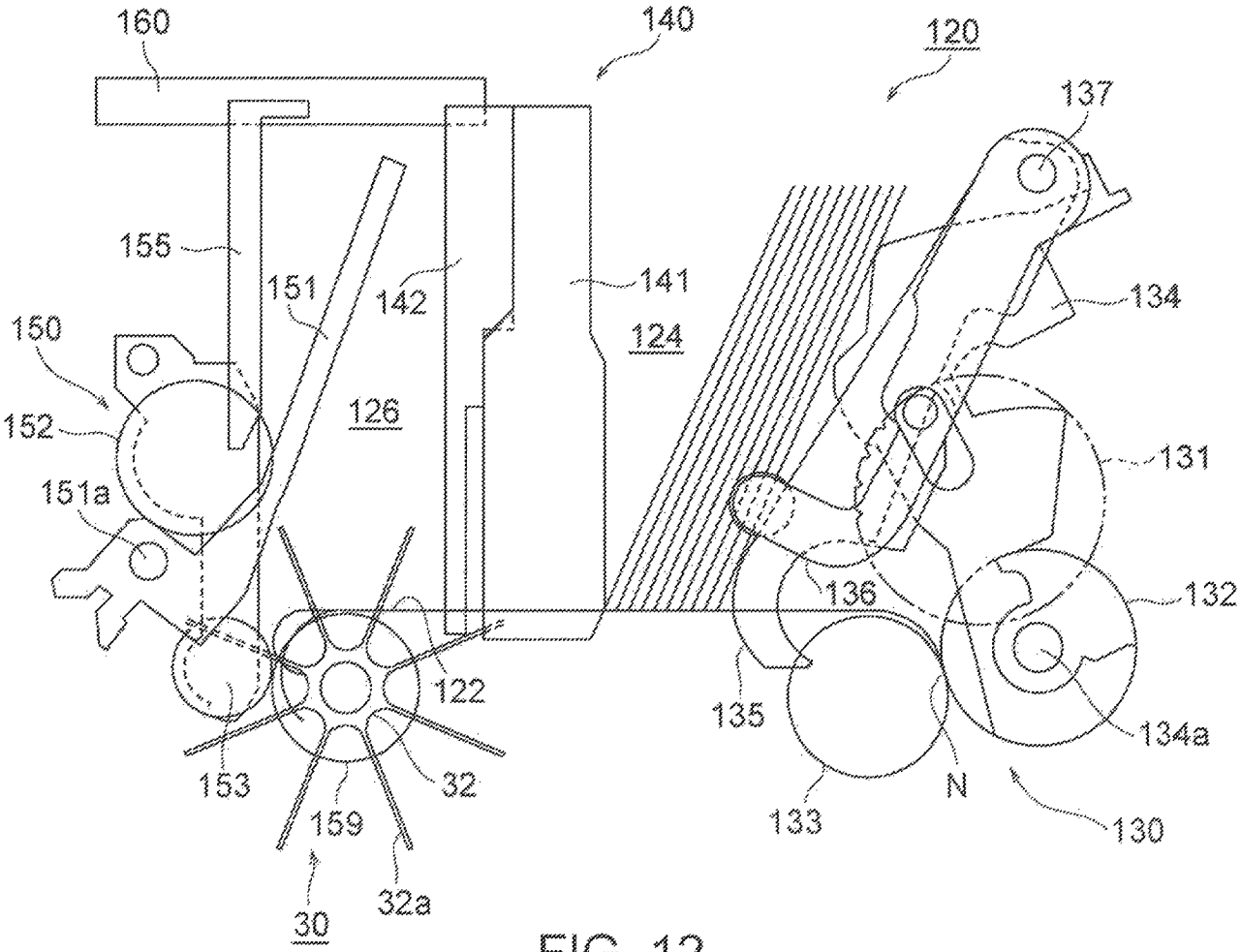
FIG. 12 is a structural diagram of the money depositing and dispensing unit of the banknote handling device shown in FIG. 11.

Moreover, as shown in FIG. 12, an inner shutter 160 that selectively regulates the access to the banknote stacking region, which includes the money depositing region 124 and the money dispensing region 126, is arranged in the money depositing and dispensing unit 120. The inner shutter 160 is movable in the left-right direction in FIG. 12.

In the banknote handling device 110 shown in FIG. 11, the money depositing and dispensing unit 120 plays the same role as played by the paper sheet stacking and feeding apparatus 10 in FIG. 1A and the like. That is, the money depositing and dispensing unit 120 functions as a banknote stacking and feeding-out device that stacks the banknotes on the mounting table 122 as the stacking unit, and feeds out the banknotes stacked on the mounting table 122.

How the above-explained banknote handling device 110 operates will be explained below.

Figure 13:
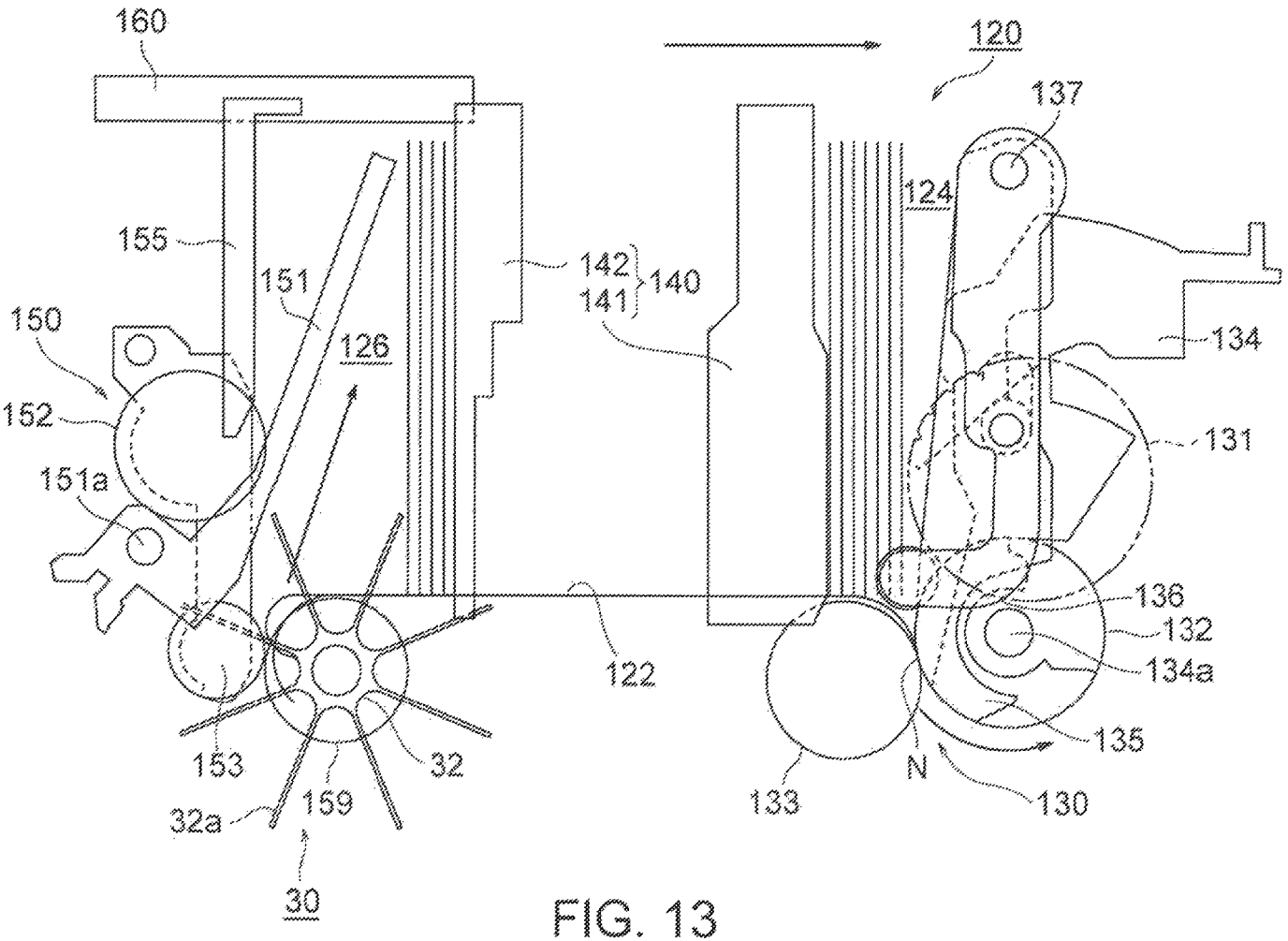
FIG. 13 is another structural diagram of the money depositing and dispensing unit of the banknote handling device shown in FIG. 11.

To begin with, a money depositing handling of depositing banknotes in the banknote handling device 110 will be explained. When the operator places the banknotes to be deposited in the money depositing region 124 and gives an instruction to the banknote handling device 110 to start the handling, the depositing-side note pressing member 141 moves in the right direction toward the kicker roller 131. However, the dispensing-side note pressing member 142 does not move in the right direction. That is, at this time, the depositing-side note pressing member 141 and the dispensing-side note pressing member 142 are separated from each other (see FIG. 13). Then, the kicker roller 131 and the feeding roller 132 rotate in the counterclockwise direction in FIG. 13. With this, the banknotes in the money depositing region 124 are, while being pressed to the right side by the depositing-side note pressing member 141, kicked one by one in the downward direction by the kicker roller 131. The kicked banknotes are fed out one by one to the inside of the housing 112 by the feeding roller 132 and sent to the transport unit 170.

The recognition unit 172 recognizes the denomination, the authenticity, the fitness, and the like of the banknotes sent from the money depositing and dispensing unit 120 to the transport unit 170 by the banknote feeding-out mechanism 130. The banknotes that are recognized by the recognition unit 172 as being the normal banknotes are sent to the deposited money escrow unit 182 by the transport unit 170 and these banknotes are temporarily escrowed in the deposited money escrow unit 182. Then, all the banknotes placed in the money depositing and dispensing unit 120 are fed out to the inside of the housing 112, the banknotes temporarily escrowed in the deposited money escrow unit 182 are sent to the money depositing cassette 180 if the operator gives an instruction to the banknote handling device 110 to confirm the deposit.

In contrast, the banknotes that are recognized as not being the normal banknotes by the recognition unit 172, and the banknotes that could not be recognized by the recognition unit 172, are sent to the money dispensing region 126 of the money depositing and dispensing unit 120 by the transport unit 170 as deposition-rejected banknotes. Specifically, the deposition-rejected banknotes are sent in the nip between the taking-in roller 153 and the opposing roller 159 from the transport unit 170, and these banknotes are sent further in the upward direction by the taking-in roller 153 and finally stacked in the money dispensing region 126. To explain in more detail, the banknotes sent in the upward direction by the taking-in roller 153 are stacked in the region between the stacking leaver 151 and the dispensing-side note pressing member 142 (see FIG. 13).

When all the banknotes present in the money depositing region 124 are fed out to the inside of the housing 112 by the banknote feeding-out mechanism 130 and sent either to the deposited money escrow unit 182 or the money dispensing region 126 of the money depositing and dispensing unit 120, the outer shutter 114 and the inner shutter 160 open the opening 112*a* located above the money depositing and dispensing unit 120 in the housing 112. With this, the operator can access the money dispensing region 126.

When a deposition confirmation signal is sent to the banknote handling device 110, the banknotes temporarily escrowed in the deposited money escrow unit 182 are sent to the money depositing cassette 180. When the operator removes the deposition-rejected banknotes from the money dispensing region 126, the money depositing handling performed by the banknote handling device 110 is terminated.

Subsequently, a money dispensing handling of dispensing banknotes in the banknote handling device 110 will be explained. When the operator gives an instruction to the banknote handling device 110 to start the money dispensing handling, the outer shutter 114 and the inner shutter 160 close the opening 112*a* located above the money depositing and dispensing unit 120 in the housing 112. With this, the operator cannot temporarily access the money dispensing region 126.

Then, the banknotes are fed out one by one from each money dispensing cassettes 184, 186, 188 to the transport unit 170. The recognition unit 172 performs recognition of the banknotes fed out to the transport unit 170. The banknotes that are recognized by the recognition unit 172 as being the normal banknotes are sent to the money dispensing region 126 of the money depositing and dispensing unit 120 by the transport unit 170. In contrast, dispense-rejected banknotes and the like that are recognized by the recognition unit 172 as not being suitable for transporting are sent to the dispensing reject unit 176 by the transport unit 170 and stacked.

Figure 14:
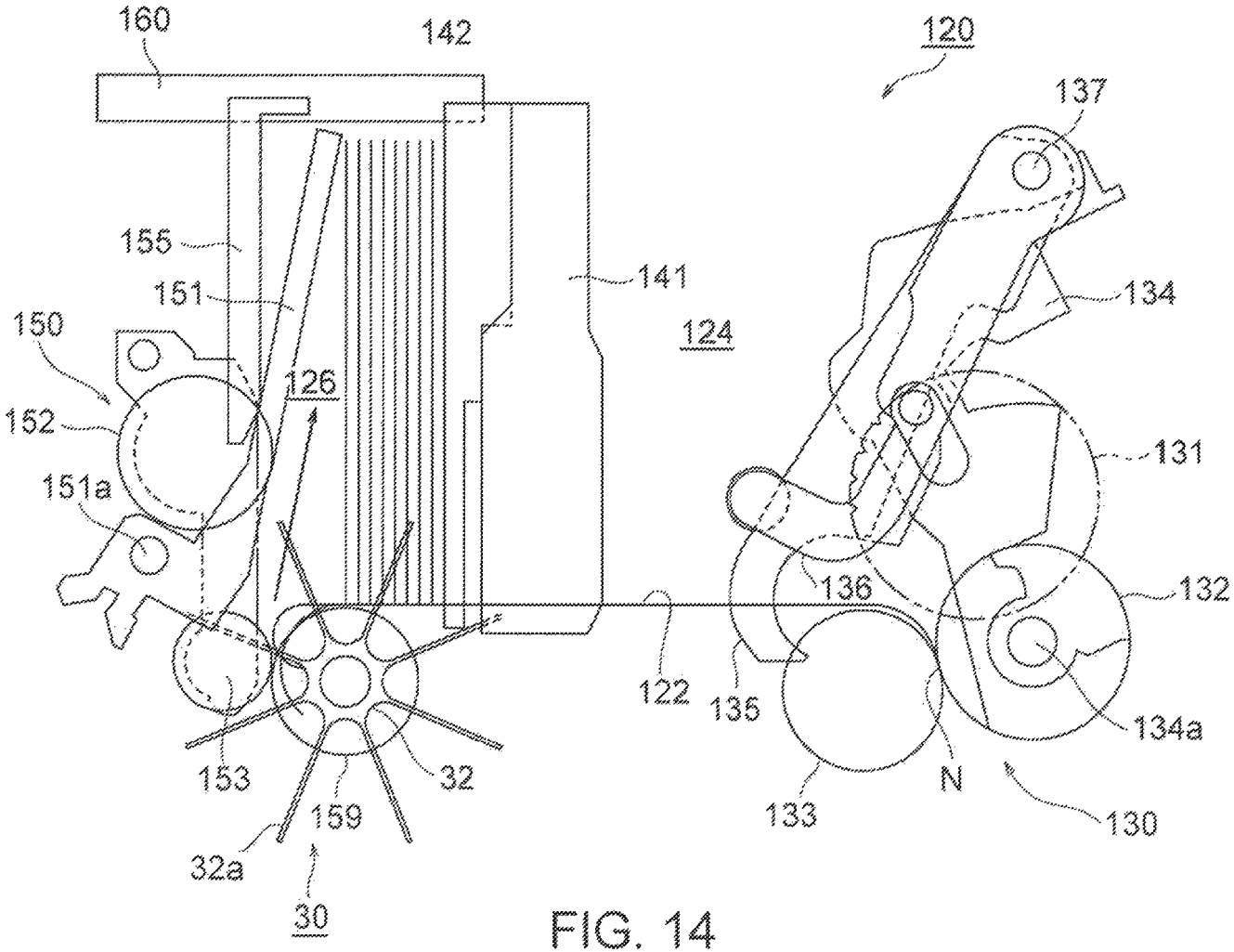
FIG. 14 is still another structural diagram of the money depositing and dispensing unit of the banknote handling device shown in FIG. 11.

To explain the money dispensing handling concretely, as shown in FIG. 14, the banknotes that are recognized by the recognition unit 172 as being the normal banknotes are sent from the transport unit 170 in the nip between the taking-in roller 153 and the opposing roller 159, and these banknotes are sent further in the upward direction by the taking-in roller 153 and finally stacked in the money dispensing region 126. To explain in more detail, the banknotes sent in the upward direction by the taking-in roller 153 are stacked in the region between the stacking leaver 151 and the dispensing-side note pressing member 142. In this process, by rotating the stacking wheel 32 of the stacking wheel mechanism 30 in the clockwise direction in FIG. 14, the tip end portions of the blades 32*a* of the stacking wheel 32 are caused to contact the surface of the banknote that has passed through the nip between the taking-in roller 153 and the opposing roller 159, whereby the banknotes can be surely sent to the money dispensing region 126 by the blades 32*a*. Because the stacking wheel 32 rotates in the feeding-in direction of the banknote to the mounting table 122 as the stacking unit, the blades 32*a* of the stacking wheel 32 enter into the transport path of the banknote.

When the banknotes of a predetermined amount of money are sent to the money dispensing region 126, the outer shutter 114 and the inner shutter 160 open the opening 112*a* located above the money depositing and dispensing unit 120 in the housing 112. With this, the operator can access the money dispensing region 126. When the operator removes the banknotes to be dispensed from the money dispensing region 126, the money dispensing handling is terminated.

On the other hand, when any of the money dispensing cassettes 184, 186, 188 becomes empty while money is being dispensed, i.e., when all the banknotes in any of the money dispensing cassettes 184, 186, 188 are dispensed and there is shortage of banknotes of a specific denomination, further handling in the banknote handling device 110 is temporarily stopped. When this happens, the banknotes stacked in the money dispensing region 126 are fed out in the downward direction by the feeding roller 152 and the taking-in roller 153. Moreover, the stacking wheel 32 of the stacking wheel mechanism 30 rotates, accompanying the rotation of the opposing roller 159, in the feeding-out direction (that is, the counterclockwise direction in FIG. 14) of the banknote from the mounting table 122 as the stacking unit. However, because the blade guiding member 38 is provided in the stacking wheel mechanism 30, the blades 32*a* of the stacking wheel 32 retreat from the transport path of the banknote. Accordingly, when feeding out the banknotes stacked in the money dispensing region 126 by using the feeding roller 152 and the taking-in roller 153 in the downward direction, because the blades 32*a* of the stacking wheel 32 have retreat from the transport path of the banknote, it is prevented that the blades 32*a* of the stacking wheel 32 contact the banknote fed out one by one from the money dispensing region 126 by the feeding roller 152 and the taking-in roller 153.

In this manner, the stacking wheel mechanism 30 according to the present embodiment can be used in the money depositing and dispensing unit 120 of the banknote handling device 110 shown in FIG. 11. Even in this case, by arranging the blade guiding member 38 near the stacking wheel 32, which rotates accompanying the rotation of the opposing roller 159, at such a position that, when the stacking wheel 32 rotates in the direction (that is, the counterclockwise direction in FIG. 14) in which the banknotes are fed out one by one from the money dispensing region 126 by the feeding roller 152 and the taking-in roller 153, the blades 32*a* of the stacking wheel 32 can be guided such that the blades 32*a* retreat from the transport path of the banknote. Therefore, when feeding out the banknotes from the money dispensing region 126 by using the feeding roller 152 and the taking-in roller 153, because the blades 32*a* of the stacking wheel 32 can be retreated from the transport path of the banknote, it is not necessary to provide a mechanism to move the stacking wheel 32, and cost reduction can be realised. Moreover, because a retreating space for retreating the stacking wheel 32 becomes needless, downsizing of the device can be realized.

The invention claimed is:

1. A paper sheet stacking and feeding apparatus for stacking a paper sheet in a stacking unit and feeding out the paper sheet from the stacking unit, comprising:

a transport path along which the paper sheet passes during both of stacking the paper sheet in the stacking unit and feeding out the paper sheet from the stacking unit;

a stacking wheel that is rotatable in both of a feeding-in direction of the paper sheet toward the stacking unit and a feeding-out direction of the paper sheet from the stacking unit, the stacking wheel having a plurality of elastic blades extending from an outer circumferential surface thereof; and a blade guiding member that guides the blades of the stacking wheel such that the blades enter into the transport path when the stacking wheel rotates in the feeding-in direction of the paper sheet toward the stacking unit and the blades do not enter into the transport path when the stacking wheel rotates in the feeding-out direction of the paper sheet from the stacking unit, wherein the blade guiding member is fixedly provided so that the blade guiding member does not move.

2. The paper sheet stacking and feeding apparatus according to claim 1, further comprising:

a paper-sheet guiding member that guides the paper sheet so that the paper sheet is transported along the transport path; and an opening arranged in the paper-sheet guiding member so that the blades of the stacking wheel pass through the opening; wherein the blade guiding member guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

3. A paper sheet stacking and feeding apparatus for stacking a paper sheet in a stacking unit and feeding out the paper sheet from the stacking unit, comprising:

a transport path along which the paper sheet passes during both of stacking the paper sheet in the stacking unit and feeding out the paper sheet from the stacking unit;

a paper-sheet guiding member that guides the paper sheet so that the paper sheet is transported along the transport path;

a stacking wheel that is rotatable in both of a feeding-in direction of the paper sheet toward the stacking unit and a feeding-out direction of the paper sheet from the stacking unit, the stacking wheel having a plurality of elastic blades extending from an outer circumferential surface thereof;

an opening arranged in the paper-sheet guiding member so that the blades of the stacking wheel pass through the opening;

a blade guiding member that guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

4. The paper sheet stacking and feeding apparatus according to claim 3, wherein the opening is arranged so that the blades do not pass through the opening when the stacking wheel rotates in the feeding-out direction of the paper sheet from the stacking unit.

5. The paper sheet stacking and feeding apparatus according to claim 3, wherein the blade guiding member includes a tip end portion arranged near the opening and extending toward the opening with respect to the axial direction of the stacking wheel, and the blades deform in the axial direction of the stacking wheel by contacting the tip end portion before the blades arrive at the opening when the stacking wheel rotates in the feeding-out direction of the paper sheet from the stacking unit.

6. The paper sheet stacking and feeding apparatus according to claim 3, wherein the blades are bent by contacting the blade guiding member when the stacking wheel rotates in the feeding-out direction of the paper sheet from the stacking unit and do not enter into the transport path.

7. The paper sheet stacking and feeding apparatus according to claim 3, wherein the blades are bent by contacting the paper-sheet guiding member when the stacking wheel rotates in the feeding-out direction of the paper sheet from the stacking unit and do not enter into the transport path.

8. The paper sheet stacking and feeding apparatus according to claim 3, wherein the blade guiding member has a surface that the blades of the stacking wheel contact when the stacking wheel rotates in the feeding-in direction of the paper sheet toward the stacking unit, and the surface is inclined to a plane that is parallel to the axial direction of the stacking wheel and a surface that is orthogonal to the axial direction of the stacking wheel.

9. The paper sheet stacking and feeding apparatus according to claim 3, wherein, the blade guiding member blocks a portion of the opening in the paper-sheet guiding member, when viewed along a direction that is orthogonal to the axial direction of the stacking wheel.

10. The paper sheet stacking and feeding apparatus according to claim 3, wherein the blade guiding member is between the opening in the paper-sheet guiding member and an axis of the stacking wheel.

11. The paper sheet stacking and feeding apparatus according to claim 3, wherein the opening in the paper-sheet guiding member has a region through which a part of the blades of the stacking wheel that has been bent by contacting the blade guiding member passes, when the stacking wheel rotates in the feeding-in direction of the paper sheet toward the stacking unit.

12. A paper sheet handling device, comprising:

a stacking unit that stacks a paper sheet and provided with a paper-sheet feeding-out mechanism that feeds out the paper sheet stacked in the stacking unit one by one;

a transport path along which the paper sheet passes during both of stacking the paper sheet in the stacking unit and feeding out the paper sheet from the stacking unit;

a paper-sheet guiding member that guides the paper sheet so that the paper sheet is transported along the transport path;

a stacking wheel that is rotatable in both of a feeding-in direction of the paper sheet toward the stacking unit and a feeding-out direction of the paper sheet from the stacking unit, the stacking wheel having a plurality of elastic blades extending from an outer circumferential surface thereof;

an opening arranged in the paper-sheet guiding member so that the blades of the stacking wheel pass through the opening;

a blade guiding member that guides the blades of the stacking wheel such that the blades of the stacking wheel enter into the transport path by passing through the opening in the paper-sheet guiding member when the stacking wheel rotates in the feeding-in direction of the paper sheet toward the stacking unit and the blades of the stacking wheel deform in an axial direction of the stacking wheel by contacting the blade guiding member and do not enter into the transport path when the stacking wheel rotates in the feeding-out direction of the paper sheet from the stacking unit.

13. The paper sheet handling device according to claim 12, wherein the opening is arranged so that the blades do not pass through the opening when the stacking wheel rotates in the feeding-out direction of the paper sheet from the stacking unit.

14. The paper sheet handling device according to claim 12, wherein the blade guiding member includes a tip end portion arranged near the opening and extending toward the opening with respect to the axial direction of the stacking wheel, and the blades deform in the axial direction of the stacking wheel by contacting the tip end portion before the blades arrive at the opening when the stacking wheel rotates in the feeding-out direction of the paper sheet from the stacking unit.

15. The paper sheet handling device according to claim 12, wherein the blades are bent by contacting the blade guiding member when the stacking wheel rotates in the feeding-out direction of the paper sheet from the stacking unit and do not enter into the transport path.

16. The paper sheet handling device according to claim 12, wherein the blades are bent by contacting the paper-sheet guiding member when the stacking wheel rotates in the feeding-out direction of the paper sheet from the stacking unit and do not enter into the transport path.

17. The paper sheet handling device according to claim 12, wherein the blade guiding member has a surface that the blades of the stacking wheel contact when the stacking wheel rotates in the feeding-in direction of the paper sheet toward the stacking unit, and the surface is inclined to a plane that is parallel to the axial direction of the stacking wheel and a surface that is orthogonal to the axial direction of the stacking wheel.

18. The paper sheet handling device according to claim 12, wherein, the blade guiding member blocks a portion of the opening in the paper-sheet guiding member, when viewed along a direction that is orthogonal to the axial direction of the stacking wheel.

19. The paper sheet handling device according to claim 12, wherein the blade guiding member is between the opening in the paper-sheet guiding member and an axis of the stacking wheel.

20. The paper sheet handling device according to claim 12, wherein the opening in the paper-sheet guiding member has a region through which a part of the blades of the stacking wheel that has been bent by contacting the blade guiding member passes, when the stacking wheel rotates in the feeding-in direction of the paper sheet toward the stacking unit.

* * * * *